US006818369B2

(12) United States Patent
Sugiura et al.

(10) Patent No.: US 6,818,369 B2
(45) Date of Patent: Nov. 16, 2004

(54) TONER FOR ELECTROSTATIC IMAGE DEVELOPMENT AND IMAGE FORMING METHOD AND APPARATUS USING THE TONER

(75) Inventors: Hideki Sugiura, Shizuoka (JP); Satoshi Mochizuki, Shizuoka (JP); Yasuo Asahina, Shizuoka (JP); Kazuhiko Umemura, Shizuoka (JP); Minoru Masuda, Shizuoka (JP); Kohsuke Suzuki, Shizuoka (JP); Tomomi Tamura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/059,240

(22) Filed: Jan. 31, 2002

(65) Prior Publication Data

US 2002/0160290 A1 Oct. 31, 2002

(30) Foreign Application Priority Data

Jan. 31, 2001 (JP) ..... 2001-024677
Nov. 30, 2001 (JP) ..... 2001-367550
Jan. 30, 2002 (JP) ..... 2002-021795

(51) Int. Cl.[7] ..... G03G 9/087

(52) U.S. Cl. ..... 430/108.1; 430/107.1; 430/109.1; 430/109.2; 430/109.4; 430/111.4; 430/120; 430/137.1; 528/87; 523/402

(58) Field of Search ..... 430/108.1, 109.1, 430/109.2, 109.4, 107.1, 120, 111.4, 137.1, 137.18; 528/87; 399/252; 523/402

(56) References Cited

U.S. PATENT DOCUMENTS

| | | | | | |
|---|---|---|---|---|---|
| 4,762,763 | A | | 8/1988 | Nomura et al. | |
| 4,933,250 | A | | 6/1990 | Nakayama et al. | |
| 4,950,573 | A | | 8/1990 | Yamaguchi et al. | |
| 4,980,258 | A | | 12/1990 | Aoki et al. | |
| 5,061,588 | A | * | 10/1991 | Fushimi et al. | 430/109.2 |
| 5,344,732 | A | | 9/1994 | Chiba et al. | |
| 5,403,690 | A | | 4/1995 | Kuramoto et al. | |
| 5,554,478 | A | | 9/1996 | Kuramoto et al. | |
| 5,721,083 | A | | 2/1998 | Masuda et al. | |
| 5,840,456 | A | | 11/1998 | Tomita et al. | |
| 6,020,100 | A | * | 2/2000 | Iwasaki et al. | 430/137.18 |
| 6,074,794 | A | | 6/2000 | Fushimi et al. | |
| 6,074,795 | A | | 6/2000 | Watanabe et al. | |
| 6,124,070 | A | * | 9/2000 | Baba et al. | 430/111.4 |
| 6,180,298 | B1 | | 1/2001 | Kuroda et al. | 430/45 |
| 6,303,258 | B1 | | 10/2001 | Katoh et al. | 430/110.1 |
| 6,356,729 | B1 | | 3/2002 | Sasaki et al. | 430/110.4 |
| 6,360,068 | B1 | | 3/2002 | Kinoshita et al. | 399/284 |
| 6,363,229 | B1 | | 3/2002 | Shiraishi et al. | 399/68 |
| 6,368,765 | B2 | | 4/2002 | Izu et al. | 430/137.2 |
| 6,395,443 | B2 | | 5/2002 | Kuroda et al. | 430/110.4 |
| 6,403,275 | B1 | | 6/2002 | Kuramoto et al. | 430/111.4 |
| 6,406,826 | B1 | | 6/2002 | Suzuki et al. | 430/111.35 |
| 6,432,589 | B1 | | 8/2002 | Uchinokura et al. | 430/18 |
| 6,447,973 | B1 | | 9/2002 | Asami et al. | 430/114 |
| 6,468,706 | B2 | | 10/2002 | Matsuda et al. | 430/108.6 |
| 6,503,681 | B2 | | 1/2003 | Makino et al. | 430/137.2 |
| 6,569,590 | B2 | * | 5/2003 | Kuroda et al. | 430/108.6 |
| 2001/0051270 | A1 | | 12/2001 | Yamashita et al. | 430/107.1 |
| 2002/0006564 | A1 | | 1/2002 | Kondou et al. | 430/45 |
| 2002/0037467 | A1 | | 3/2002 | Watanabe et al. | 430/110.1 |
| 2002/0192580 | A1 | * | 12/2002 | Kuramoto et al. | 430/109.2 |

FOREIGN PATENT DOCUMENTS

| | | |
|---|---|---|
| JP | 49-46951 | 12/1974 |
| JP | 52-17023 | 2/1977 |
| JP | 52-86334 | 7/1977 |
| JP | 52-156632 | 12/1977 |
| JP | 57-130043 | 8/1982 |
| JP | 57-130044 | 8/1982 |
| JP | 60-263951 | 12/1985 |
| JP | 61-24025 | 2/1986 |
| JP | 61-219051 | 9/1986 |
| JP | 61-235852 | 10/1986 |
| JP | 62-280755 | 12/1987 |
| JP | 1-267560 | 10/1989 |
| JP | 1-304467 | 12/1989 |
| JP | 2-66561 | 3/1990 |
| JP | 4-39671 | 2/1992 |
| JP | 4-230770 | 8/1992 |
| JP | 9-101632 | 4/1997 |
| JP | 10-10782 | 1/1998 |
| JP | 11-189646 | 7/1999 |
| JP | 11-249334 | 9/1999 |

OTHER PUBLICATIONS

Trademark Electronic Search System (Tess) Printout Dated on Aug. 3, 2004, of Trademark Henschel Mixer, Serial No. 75599986*

* cited by examiner

*Primary Examiner*—Janis L. Dote
(74) *Attorney, Agent, or Firm*—Oblon, Spivak, McClelland, Maier & Neustadt, P.C.

(57) ABSTRACT

A toner for electrostatic image development in which the weight concentration of polar-solvent-soluble material is 1000 $\mu$g/g or less, based on the toner, and an image forming method comprising a step of forming a toner image by developing a latent electrostatic image by using the toner for electrostatic image development.

26 Claims, 2 Drawing Sheets

Figure 1:
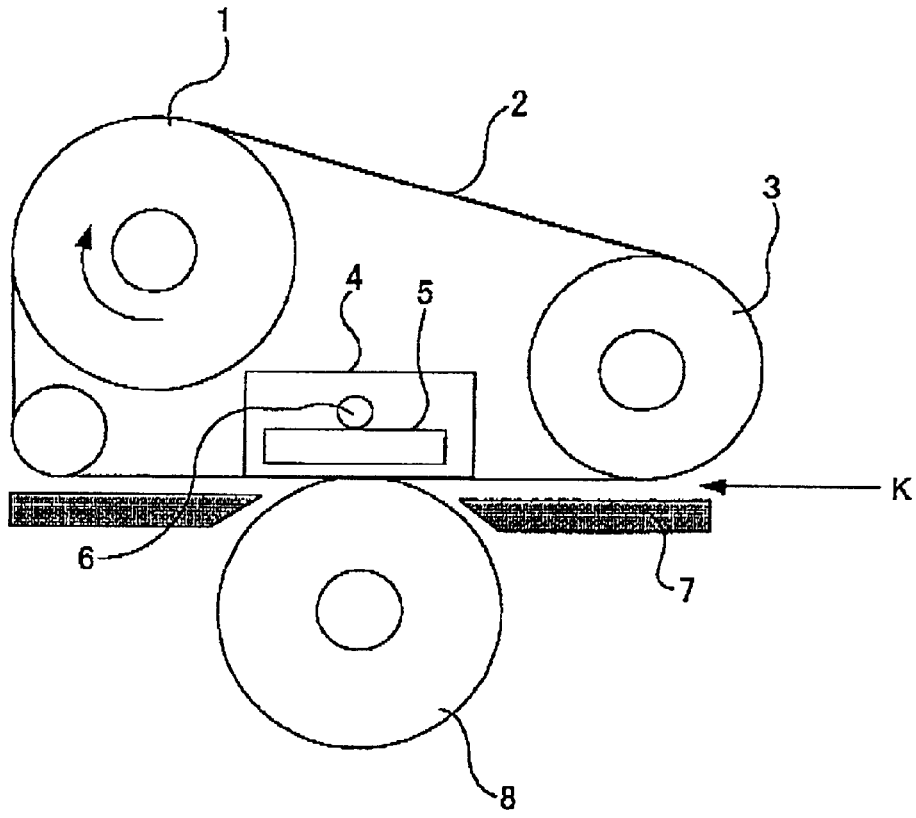

TONER FOR ELECTROSTATIC IMAGE DEVELOPMENT AND IMAGE FORMING METHOD AND APPARATUS USING THE TONER

BACKGROUND OF THE INVENTION

1. Field of the Invention

The present invention relates to a resin for a toner for electrostatic image development, a master batch pigment, a toner, a developer, an image forming method, and an image forming apparatus.

2. Description of the Related Art

Image forming apparatuses such as copiers, facsimile machines, printers, and the like have been used everywhere following the increase in the office work. An image forming method using a typical electrophotographic system in such image forming apparatuses comprises a charging process in which the surface of a latent image bearing member is uniformly charged, an exposure process in which the surface is exposed imagewise and charges in the exposed zones are removed to form an electric latent image (electrostatic image), a development process in which a fine toner particle bearing an electric charge is caused to adhere to the latent image to visualize it, a transfer process in which the obtained visible image is transferred onto a transfer material such as paper, and a fixing process in which the visible image is fixed on the transfer body by heating or pressing (usually a thermal roller is used).

Two-component developers comprising a carrier and a toner and one-component developers (magnetic toners, non-magnetic toners) containing only a toner and requiring no carrier are known as the developers for developing electrostatic images formed on the latent image bearing member.

Toners used in such image forming methods comprise a binder resin and a coloring agent as the main components and, if necessary, also contain additives such as charge control agents, offset-preventing agents, and the like. The toners are required to have various properties in the above-mentioned processes. For example, in the development process, the toner and the binder resin for the toner are required to retain the amount of electric charge suited to image forming apparatuses such as copiers, printers, without being affected by ambient conditions such as temperature, humidity, and the like Furthermore, in the fixing process employing a thermal roller fixing system, the toner is required to have good anti-offset performance, that is, show no adhesion to the thermal roll, and good fixability to paper and the like. Moreover, the toner is also required to have blocking resistance properties and show no blocking during storage inside the image forming apparatuses.

In copiers, printers, facsimile machines employing an image forming method such as electrophotography, electrostatic recording, electrostatic printing, and the like, the toner is usually fixed to paper by using a heated roller which is heated to a temperature of about 100~230° C. In such a fixing process, fixing is most often continuously conducted on a large number of paper sheets and a toner is accumulated on the heated roller in a very small amount insufficient to affect the anti-offset performance. Because of continuous rotation and continuous supply of paper, the temperature of the heated roller increases and the toner that accumulated on the heated roller is heated. As a result, the residual monomers or residual solvent remaining in the toner are evaporated, producing offensive odor.

This offensive odor is caused by starting materials present in the toner, such as binder resins, pigments, charge control agents, additives, master batch pigments in which a resin is mixed with a pigment, and the like, or by residual monomers, low-molecular-weight components, volatile components such as residual solvents, components soluble in polar solvents or polar-solvent-soluble material, various components soluble in polar solvents which are produced during toner manufacture, and the like. Therefore, it is necessary to decrease the amount of residual monomers, residual solvents, volatile components, and components soluble in polar solvents, which are present in the starting materials, toner, and developer.

With respect to those requirements, for example, in Japanese Patent Application Laid-open No. H10-10782, the evaluation was conducted by a hardly objective method of deciding as to whether the offensive odor was felt or not, or the amount of volatile components was determined by the difference in weight before and after drying and could not be fully distinguished from the amount of water-containing components. Furthermore, in Japanese Patent Application Laid-open No H11-249334, the amount of residual monomers remaining in the toner was specified, but sufficient attention was not paid to the method for detecting the monomer components, the amount of monomer components detected by usual gas chromatography was specified, and the amount of components soluble in polar solvents, which presently pose a problem, was not filly taken into account. Japanese Patent Application Laid-open No H10-10782 is merely a description of a special suspension polymerized toner and only describes in detail a method for the manufacture thereof, providing no general description. Moreover, the object is the amount of volatile components, rather than the components soluble in polar solvents representing the present object. Japanese Patent Application Laid-open No. H11-249334 is described hereinbelow. However, it contained no general description, and the effect of the present object could not be fully demonstrated. Furthermore, all of the monomer components were controlled, rather than components soluble in polar solvents of the present object. The components soluble in polar solvents also contain dimer and trimer components other than monomers, and the amount of polar solvent insolubles such as non-polar solvents, e.g., hexane and the like, in the monomers is large. Japanese Patent Application Laid-open No. H11-249334 teaches, for example, the residual monomer can be removed by restricting the amount of residual monomer by means of temperature control or by conducting distillation after polymerization, or by using a method of adding an initiator during toner manufacture by a direct polymerization method or in the manufacture of binder resin Furthermore, when the toner is manufactured by grinding, the monomers can be removed by reducing pressure during heating and kneading of starting material with a kneader, or the residual monomers can be removed with a comparatively good efficiency by using spray drying in the manufacture of the toner. In particular, when the toner is manufactured by a suspension polymerization method, the removal can be conducted even when the toner particles are heated and dried, Furthermore, the requirement relating to the decrease in the content of residual solvents, volatile components, and components soluble in polar solvents is important not only in terms of environmental protection, that is, from the standpoint of ecology, and human safety (carcinogenic and toxic substances), but also in terms of resolving the problem of toner quality. For example, recent research conducted by the inventors clearly showed that the components soluble in polar solvents which are present in the toner caused carrier spent, decreased the amount of electric charge of the toner, and were one of the reasons for decreased image density On the other hand, because of properties required for binder resins for toners, that is, transparency, insulating properties, water resistance, flowability (as a powder), mechanical strength, gloss, thermoplasticity, grindability, and the like, polystyrene styrene—acryl copolymers, polyester resins, and epoxy resins have been usually used as the binder resins. Among them, styrene resins have been widely used because of their excellent grindability, water resistance, and flowability.

The following problem, however, was associated with toners containing styrene resins and toners containing polyester resins. Thus, when copies obtained by using such toners, were stored in document holders made of vinyl chloride resin sheets, because the image surface on the copies was allowed to be in a state of intimate contact with the vinyl chloride resin sheets, a plasticizer contained in the sheets, that is, in the vinyl chloride resin, migrated onto the fixed toner image and plasticized it, causing fusion of the image to the sheet. As a result, when the copy was separated from the sheet, the toner image was partially or entirely peeled from the copy. Moreover, the sheet was contaminated.

In order to prevent such a transition of image onto the vinyl chloride resin sheets, Japanese Patent Applications Laid-open Nos. S60-263951 and S61-24025 suggested to blend an epoxy resin which is not plasticized by plasticizers for vinyl chloride resins with a styrene resin or polyester resin as a binder resin. However, when such blended resins were used, in particular, for color toners, uncompatibility of different resins caused problems associated with anti-offset performance, curling of fixed images, glossiness (absence of gloss on color toner images creates an appearance of scanty image), coloration ability, transparency, and color forming ability. Those problems cannot be completely resolved by the conventional epoxy resins or acetylated modified epoxy resins suggested by Japanese Patent Applications Laid-open No. S61-235852

Resolution of the above-mentioned problems by using an epoxy resin alone can be considered, but such an approach leads to a new problem of reaction of the epoxy resin with amines. Epoxy resins usually have a crosslinked structure obtained by the reaction of epoxy groups and a curing agent and are used as cured resins having excellent mechanical strength and chemical resistance. Curing agents can be generally classified into amine-based agents and agents based on anhydrides of organic acids. Obviously epoxy resins suitable for toners are employed as thermoplastic resins, but amines may be present in dyes, pigments, and charge control agents kneaded together with the resin in the toner and a crosslinking reaction sometimes occur during kneading, making the composition unsuitable as a toner. Furthermore, chemical activity of epoxy groups is considered to have a toxic character, for example, to irritate the skin, and fill attention should be paid to the presence thereof Since epoxy groups also demonstrate hydrophilicity, they intensely absorb water under high-temperature and high-humidity conditions, causing decrease in the electric charge, toner deposition on the background of images, and cleaning defects. One more problem is associated with charge stability in epoxy resins.

A toner is typically composed of a binder resin, a coloring agent, and a charge control agent. Various dyes and pigments are known as colorants, some of them also have a charge control ability, and some act as both the coloring agent and the charge control agent. Toners have been widely manufactured with the above-described various compositions by using epoxy resins as binders, but problems are associated with dispersibility of dyes, pigments, and charge-control agents Thus, kneading of a binder resin and a dye or pigment, and a charge control agent is typically conducted with a thermal roll mill in which the dye or pigment and the charge control agent are dispersed in the binder resin. A fully homogeneous dispersion is, however, difficult to obtain. If the dispersion of dye or pigment serving as a coloring agent is poor, the color forming ability is degraded and the degree of coloration is also decreased. Another problem is that if the dispersion of charge control agent is poor, the charge distribution becomes non-uniform and a variety of defects are caused, for example, charge defects, toner deposition on the background of images, scattering, insufficient ID, spread, cleaning defects, and the like.

Furthermore, Japanese Patent Application Laid-open No. S61-219051 discloses a toner using an epoxy resin ester modified with e-caprolactone, and though flowability and resistance to vinyl chloride were improved, the modification ratio was 15–90 wt. %, the softening point became too low, and gloss was too intensive Japanese Patent Applications Laid-open No. S52-86334 disclosed a positively charged composition prepared by conducting a reaction of aliphatic primary or secondary amine with terminal epoxy groups of the already prepared epoxy resin. However, as described above, a crosslinking reaction occurs between epoxy groups and amines, sometimes making the composition unsuitable for toners. Japanese Patent Applications Laid-open No. S52-156632 disclosed a process for conducting a reaction of alcohols, phenols, Grignard reagent, sodium acetylides of organic acids, alkyl chlorides, and the like with any one or both terminal epoxy groups of epoxy resins However, when an epoxy group remains, a problem is associated, as described above, with reactivity with amines, toxicity, hydrophilicity, and the like. Moreover, hydrophilic components, components affecting the electric charge, and components affecting grinding ability in toner preparation are present in the reaction product, and good toner is not necessarily obtained.

Japanese Patent Application Laid-open H1-267560 discloses a composition prepared by reacting both terminal epoxy groups of an epoxy resin with a compound containing one active hydrogen atom, followed by esterification with monocarboxylic acids, ester derivatives thereof or lactones. Though the problem of reactivity, toxicity, and hydrophilicity of the epoxy resin was resolved, curling during fixing was not particularly improved.

Furthermore, solvents such as xylene were usually widely used during synthesis of epoxy resins or polyol resins (for example Japanese Patent Applications Laid-open No. H11-189646). However, a problem was that those solvents or unreacted residual monomers such as bisphenol A were present in rather significant amounts in the manufactured resins and large residual amounts thereof were also present in the toners using such resins.

On the other hand, in a typical method for the manufacture of toners, for example, as disclosed in Japanese Patent Applications Laid-open No. H1-304467, all starting material are mixed together, then heated, melted, and dispersed with a kneader, producing a homogeneous composition which is then cooled, ground and classified producing a toner with a volume-average particle size of about 6~10 mm.

In color toners used to form color images, various color-bearing dyes or pigments are usually dispersed in a binder resin In such case, requirements imposed on the toner used are more stringent than those in case of black images. Thus, in addition to mechanical and electrical stability against external factors such as impacts or humidity, the color toners are required to have an appropriate color appearance (degree of coloration) or light permeability (transparency) when used in overhead projectors (OHB).

Color toners using dyes as coloring agents are described, for example, in Japanese Patent Applications Laid-open Nos. S57-130043 and S57-130044. When a dye is used as a coloring agent, the image obtained has excellent transparency, the color forming ability is good, and a bright color image can be formed. However; in this case, a problem is associated with a poor light resistance of toners, which results in discoloration or color fading under the effect of direct light.

Color toners using pigments as coloring agents are described, for example, in Japanese Patent Applications Laid-open Nos. S49-46951 and S52-17023. However, though the pigment-containing color toners have excellent resistance to light, the dispersibility of pigments in the binder resin is poor, degrading degree of coloration (color forming ability) or transparency Methods for improving dispersibility of pigments in binder resins are described in Japanese Patent Applications Laid-open Nos. S62-280755 and H2-66561. However, none of those methods provided for sufficient dispersion of pigments and the degree of coloration and transparency were poor. Furthermore methods described in Japanese Patent Applications Laid-open Nos. H9-101632, H4-39671, and H4-230770 improved the dispersion of pigments, but since all of those methods used solvents, a problem was associated with a rather large amount of residual solvent. Another problem was that using the solvents resulted in increased content of components soluble in polar solvents.

The advantage of contactless thermal fixing over that using thermal rollers is that resolution of images during development is not degraded, no paper jams are caused, and high-speed printing or simultaneous printing on both sides can be effectively conducted However, with the contactless thermal fixing, the ratio of energy dissipated into environment is higher, thermal efficiency is poor, and power consumption is high For this reason, the amount of provided heat is greater than that provided by thermal rollers, heat effect on the toner is large, and the increase in the amount of volatile components or components soluble in polar solvents has to be taken into account Furthermore, attempts were made to develop a fixing system with a low energy consumption by using thin-wall rollers having a small thickness of roller layer in order to increase thermal efficiency of fixing rollers or by using fixing with a low surface pressure of a film or belt to improve fixing efficiency Toners that have to be suitable for such systems also should be adequate for low-temperature and low-pressure fixing, and offset-free toners are required. As a result, it was necessary to decrease the average molecular weight or to increase the amount of components with a low molecular weight in order to make the toner suitable for low-temperature fixing, which inevitably could lead to the increase in the amount of volatile components and components soluble in polar solvents that have a low molecular weight.

Further, laser printers of the above-described electrophotographic system can be used as on-demand publishing systems printing only necessary materials, at necessary time, in necessary quantities A significant advantage of such on-demand publishing systems is that the printing cost is reduced, no storage is required for printed products, and delivery period is shortened However, the amount of printing per day increases according to customers' demand Thus, one or several laser printers are operated in a room of limited space and printed products are produced within the whole day. As a result, the consumption of toner greatly increases, and the conventional toners and developers containing a large amount of components soluble in polar solvents have been shown to constitute a threat to operator's health.

SUMMARY OF THE INVENTION

The inventors have discovered that a toner, a binder resin, a master batch pigment, a developer, an image forming method, and an image forming apparatus producing little offensive odor, constituting no threat to operator's health and safety, having excellent environmental charge stability and environment protection ability, causing few troubles such as image density decrease, and providing for excellent balance of fixability and resistance to offset as well as excellent color reproducibility and brightness can be obtained by decreasing the amount of components soluble in polar solvents, which are contained in the toner, binder resin, master batch pigment, developer, and the like.

The mechanism is presently not clear, but it can be suggested that the components (for example, bisphenol A and the like) soluble in polar solvents, which are present in the toner, adhere to, and are spent on the carrier surface (the surface of a development sleeve in case of a one-component development system) contributing to electric charging of the toner during stirring and charging, which reduces the charging ability of the carrier, causes improper charging of the toner, and causes the decrease in image density.

The toner for electrostatic image development in accordance with the present invention is composed of a binder resin and a colorant or coloring agent and comprises components soluble in polar solvents at 1000 $\mu$g/g or less.

The resin for a toner in accordance with the present invention is suitable as a binder resin of a toner for electrostatic image development and has an epoxy resin portion and a polyalkylene group-containing portion at least in the main chain.

The method for the manufacture of a resin for a toner in accordance with the present invention is a method for the manufacture of a resin for a toner suitable as a binder resin of a toner for electrostatic image development and having an epoxy resin portion and a polyalkylene group-containing portion at least in the main chain, the method comprising at least a step of adding water at any stage from before the synthesis reaction to after thereof then bubbling the liquid containing the water under reduced pressure, and evaporating the liquid component containing the water The master batch pigment for a toner in accordance with the present invention is a master batch pigment suitable for a toner for electrostatic image development, the master batch pigment having a pigment dispersed in a resin for a toner having an epoxy resin portion and a polyalkylene group-containing portion at least in the main chain.

The method for the manufacture of a master batch pigment in accordance with the present invention is a method for the manufacture of a master batch pigment for a toner suitable for a toner for electrostatic image development and having a pigment dispersed in a resin for a toner having an epoxy resin portion and a polyalkylene group-containing portion at least in the main chain, the pigment being a dry powder pigment, the method comprising at least the step of preparing a mixture by mixing the dry powder pigment, the resin for an electrostatic image development toner, and water, and heating and kneading the mixture to remove the water, The electrostatic image developer in accordance with the present invention comprises at least a toner for electrostatic image development composed of at least a binder resin and a colorant and comprising components soluble in polar solvents at 1000 μg/g or less.

The image forming method in accordance with the present invention comprises a latent electrostatic image formation step in which a latent electrostatic image is formed on a latent electrostatic image bearing member and a development step in which a toner image is formed by developing the latent electrostatic image with an electrostatic image developer contained in a developing apparatus, composed of at least a binder resin and a colorant, and comprising components soluble in polar solvents at 1000 μg/g or less.

The image forming apparatus in accordance with the present invention comprises a latent electrostatic image bearing member, latent electrostatic image forming means for forming a latent electrostatic image on the latent electrostatic image bearing member, and developing means for forming a toner image by developing the latent electrostatic image, this developing means enclosing an electrostatic image developer composed of at least a binder resin and a colorant and comprising components soluble in polar solvents at 1000 μg/g or less.

BRIEF DESCRIPTION OF TIE DRAWINGS

Figure 2:
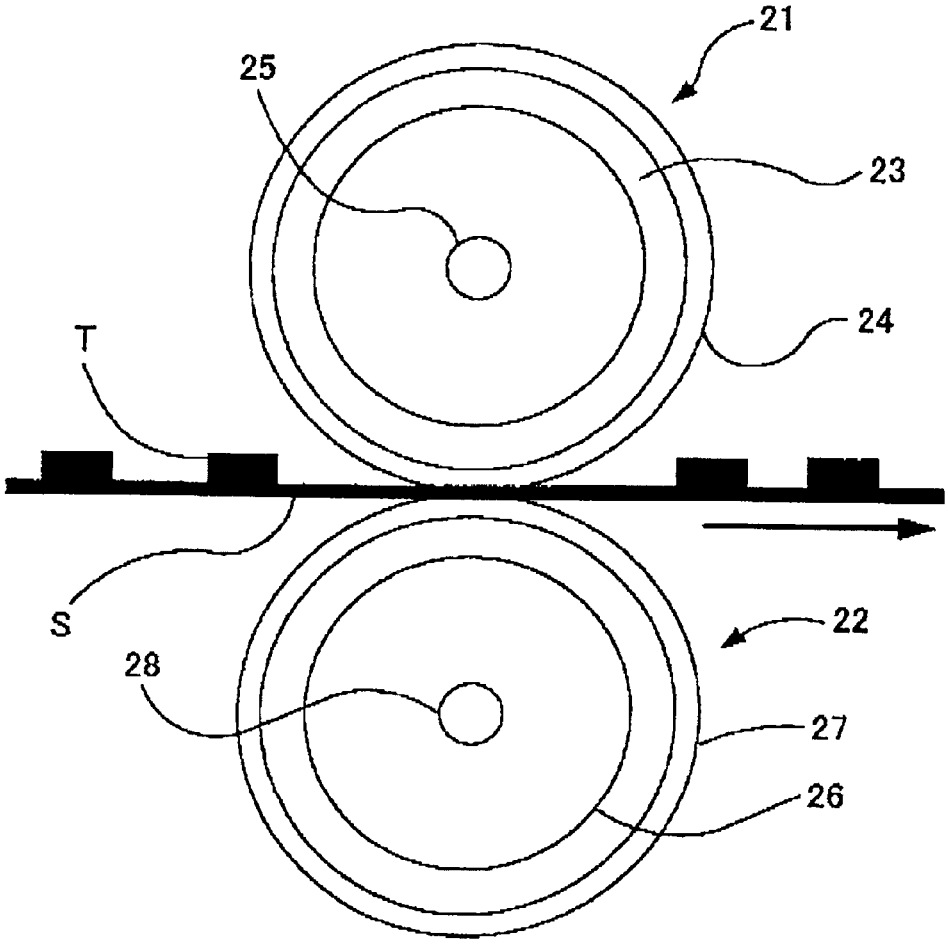

FIG. 1 is a schematic structural view illustrating an example of a fixing apparatus used in the image forming method in accordance with the present invention, and FIG. 2 is a schematic structural view illustrating an example of a fixing apparatus used in the electrophotographic image forming method in accordance with the present invention.

DESCRIPTION OF THE PREFERRED EMBODIMENTS

The present invention will be described below in greater details.

As described above, the present invention is created to obtain a good-quality toner, image, and the like by decreasing the amount of components soluble in polar solvents or a polar-solvent-soluble material, which are contained in a toner for electrostatic image development. Here, a polar-solvent-soluble material referres to a material which is soluble in a polar solvent.

The inventors have discovered that the above-described effect can be obtained if the amount of components soluble in polar solvents, which are present in a toner, is controlled to exist at 1000 μg or less, preferably 500 μg or less, still more preferably, 100 μg or less, even more preferably, 30 μg or less, and still more preferably, 10 μg o less, based on the toner. Furthermore, it is preferred that the amount be 3 μg or more per 1 g of toner. In order to obtain less than 3 μg/g, it is necessary that reactive groups with a low molecular weight such as glycidyl ether or alkylene oxide adducts of biphenols be reacted with the base polymer such as an epoxy resin, in an equivalent or lower amount when the binder resin is synthesized. As a result, a problem arises that the reactive residues of the base polymer such as epoxy groups will remain during the reaction. Chemical activity of the epoxy groups is considered to be biochemically dangerous, for example, causing skin irritation, and their presence is undesirable. Furthermore, since epoxy groups are hydrophilic, absorption of water under high temperature and high humidity conditions is significant, causing the decrease in the electric charge, background contamination, cleaning defects, and the like. One more problem is associated with degradation of electric charge stability in epoxy resins. Furthermore, it was found that if the ratio is less than 3 μg/g, then the interface of the components soluble in polar solvents and the binder resin is reduced and toner grindability is decreased. As a result, the toner yield is decreased and toner cost is increased which is undesirable. Moreover, the components soluble in polar solvents also affect the charging properties of the toner and if the amount thereof becomes too low, the amount of electric charge of the toner and the electric charge rising ability will decrease which is undesirable.

(Components Soluble in Polar Solvents)

The amount of components soluble in polar solvents, which is specified by the present invention, is a total amount of extracted components that can be dissolved in polar solvent which is a mixed solvent of 50 percent acetonitrile and 50 percent water by volume ratio, and all the substances that satisfy this condition come under this heading. Specific examples include unreacted residues of resins, resin monomer components, impurities present in colorants, impurities present in charge control agents, impurities from auxiliary additives, impurities introduced from the manufacturing line during toner manufacture, impurities contained in master batch pigments, or monomer components present in the overcoat layer of the carrier, and various components introduced as contaminants or intentionally during the manufacture of the resin, charge control agents, pigments, master batch pigments, and auxiliary additives or during the manufacture of the toner and developer (Quantitative Determination of Components Soluble in Polar Solvents)

The weight concentration of components soluble in polar solvents was determined by high-performance liquid chromatography (HPLC). Determination by gas chromatography is also possible, but HPLC is preferred from the standpoint of accuracy. A sample is dissolved in a solvent dissolving a toner or resin (for example, tetrahydrofuran (THF), toluene, methyl ethyl ketone, dichloromethane, chloroform, and the like). Then, a polar solvent which is a mixed solvent of 50 percent acetonitrile and 50 percent water by volume ratio, such as methanol and the like (for example, methanol, ethanol, n-propanol, acetonitrile; water, or mixtures thereof) is added, a precipitate is formed, polar solvent insolubles are removed, and components soluble in the polar solvent are extracted The extracted components are separated and qualitatively analyzed by HPLC and then quantitatively determined by using a standard sample.

A specific example of apparatus and conditions are described below. However this example is not limiting and any procedure can be used, provided that the components soluble in polar solvents can be measured with a high accuracy.

1. Method: High-performance liquid chromatography (HPLC).
2. Apparatus: Detectors of Alliance 2690, UV 2487 type manufactured by Waters Co.
3. Conditions: column Develosil ODS-Hg-3 (manufactured by Nomura Chemical Co., Ltd.), diameter 4.6ϕ×150 mm.

Transfer layer: water/acetonitrile=65/35.

Flow rate: 1.0 ml/min.

Detection: 228 nm.

Injected amount: 15 μL.

4. Sample preparation

A sample, 1 g, is accurately weighed into a triangular flask having a capacity of 100 ml.

THF, 30 ml, is added and the sample is dissolved.

Upon complete dissolution methanol, 50 mL, is added and a precipitate is formed.

Upon filtration with a 5A filtration paper, the solvent is removed:

Acetonitrile, 5 mL, and distilled water are added up to a constant volume of 5 mL.

The solution is filtered with a filter to obtain an HPLC sample.

A standard sample is prepared in the same manner.

From the standpoint of obtaining a toner which produces a little adverse effect on people in terms of environmental hormone problem and the like and which has excellent charge stability preventing spent formation, it is preferred that bisphenol A monomer be contained as the component soluble in polar solvents and that the amount of bisphenol A per 1 g of toner be 500 μg or less, preferably, 100 μg or less, still more preferably, 30 μg or less, and yet more preferably, 10 μg or less.

Furthermore, when the toner is a color toner for multi-color image forming method, from the standpoint of obtaining a toner for electrostatic image development which has small spread in chargeability between colors and excellent environmental charge stability, it is preferred that the difference in the weight concentration of components soluble in polar solvents between the toners of different colors be 300 μg or less, more preferably, 100 μg or less, still more preferably, 30 μg or less (ideally, 0 μg) per 1 g of the toner for each color. As a result, an image with excellent color reproducibility and brightness after development and fixing can be obtained.

Preferred is a set of at least three color toners for developing a latent electrostatic image to a multi-color image, each color toner comprising a binder resin and a coloring agent, with the total amount of a polar-solvent-soluble material contained in each of said color toners being 1000 μg or less with respect to 1 g of each of said color toners, and the amount of said polar-solvent-soluble material in at least one of said color toners being different from the amount of said polar-solvent-soluble material of any of said other color toners by an amount of 300 μg or less with respect to 1 g of any of said other color toners.

If the amount of components soluble in polar solvents is decreased, the amount of components with a low molecular weight tends to decrease and melt viscosity tends to increase. However, decreasing the toner viscosity by controlling the melt viscosity of the toner at a temperature of 140° C. to 120 mPas·sec or less is preferred because in such case the toner surface is melted when the toner image enters into a fixing region and the gloss is increased and color brightness is improved. For example, in order to more strictly control the reaction state and crosslinking state during binder resin manufacture, the reaction temperature or time and the type or amount of the catalyst are controlled, or toner kneading conditions are controlled so that the kneading is conducted intensively but without breaking the toner molecular chain or so that the kneading is conducted for a long time at a heat temperature, which makes it possible to maintain the above-described sufficient melt viscosity.

The melt viscosity of the toner was measured by a constant temperature method at a pressure of 20 kg/cm$^2$ and a diameter of die pores of 1 mm by using a flow meter of a stand-alone type (CFT-500) (manufactured by Shimadzu Corp.).

If the amount of components soluble in polar solvents is decreased, thermophysical properties of the toner are also changed. However, in order to obtain excellent fixability, color reproducibility, brightness, and color transparency, it is preferred that the softening point of the toner be 70~160° C, more preferably, 90~120° C., and that the glass transition temperature (Tg) be 40~70° C., more preferably, 50~70° C.

As for the softening point of the toner; the softening temperature was measured at a temperature rise rate of 1° C./min by using a softening point meter (manufactured by Mettler Co., model FP90).

Tg of the toner was measured under the following conditions by using the following differential scanning calorimeter.

Differential scanning calorimeter: SEIKO1DSC100SEIKO1SSC5040 (Disk Station)

Measurement conditions:

Temperature range: 25~150° C.

Temperature rise rate: 10° C./min.

Sampling time: 0.5 sec.

Sample amount: 10 mg

To make the low-temperature fixing possible and to obtain excellent fixability, color reproducibility, brightness, and color transparency, it is preferred that the number-average molecular weight (Mn) of the toner be 2000~8000, the (weight-average molecular weight)/(number-average molecular weight) (Mw/Mn) ratio be 1.5~20, and at least one peak molecular weight (Mp) be 3000~7000.

Measurements of number-average molecular weight (Mn), weight-average molecular weight (Mw), and Mp by GPC (gel permeation chromatography) were conducted in the following manner. A total of 80 mg of the sample was dissolved in 100 mL of TM to prepare a sample solution. The sample solution was filtered with a 5-mm filter, a total of 100 mL of the sample solution was injected into a column, and the retention time was measured under the following conditions Polystyrene with a known average molecular weight was used as a standard substance, the retention time was measured, and the number-average molecular weight of the sample was calculated as for polystyrene from the calibration curve that was plotted in advance.

Column: Guard Column+GLR400M+GLR400M+GLR400 (all are manufactured by Hitachi Ltd.).

Column temperature. 40° C.

Transfer phase (flow rate): THF (1 mL/min).

Peak detection method UV: (254 nm).

Examples of binder resins for the toner include polymers of styrene and substitutes thereof such as polystyrene, poly-p-chlorostyrene, polyvinyltoluene, and the like, styrene copolymers such as styrene-p-chlorostyrene copolymer, styrene-propylene copolymer, styrene-vinyltoluene copolymer, styrene vinylnaphthalene copolymer, styrene-methyl acrylate copolymer, styrene ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl a-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer, and the like; poly(methyl methacrylate), poly(butyl methacrylate), poly(vinyl chloride), poly(vinyl acetate), polyethylene, polypropylene, polyesters, epoxy resins, epoxy polyol resins, polyurethanes, polyamides, poly(vinyl butyrals), polyacrylic acid resins, rosin, modified rosin, terpene resins, aliphatic or alicyclic hydrocarbon resins, aromatic petroleum resins, chlorinated paraffins, paraffin waxes, and the like. The above resins may be used individually or in a mixture thereof Furthermore, from the standpoint of obtaining environmental stability and stable fixing properties, it is preferred than the binder resin comprise a polyol resin Moreover, from the standpoint of obtaining environmental stability and table fixing properties and preventing the transition of a toner image to a sheet when a copy fixed image surface is brought in intimate contact with a vinyl chloride resin sheet, it is preferred that the polyol resin have an epoxy resin portion and a polyalkylene group-containing portion at least in the main chain. This aspect is especially effective for obtaining a stable gloss and color reproducibility when the resin is used in color toners and for preventing curling of copy fixed images. The epoxy resin portion as referred to herein means a portion constituted by an epoxy resin. On the other hand, the polyalkylene group-containing portion means a portion constituted by a compound having a polyoxyalkylene skeleton, such as alkylene oxide adducts of diphenols. The polyol resin preferably contains polar-solvent soluble material at 1000 $\mu$g/g or less.

Furthermore, from the standpoint of environmental stability and low toxicity it is preferred that the end groups of the polyol resin of the toner binder resin be inactive The term "inactive" as used herein means that no chemically reactive substitution groups are present or that even if they are present, the amount thereof is not sufficient to produce a negative effect on quality characteristics of the toner and resin or to affect the health of people. For example, it means that epoxy rings, which have a high reactivity, are open and changed into OH groups, which results in a decreased reactivity, The epoxy resin used in accordance with the present invention is preferably obtained by bonding a bisphenol such as bisphenol A or bisphenol F and epichlorohydrin. In order to obtain stable fixing properties or gloss, it is preferred that the epoxy resin comprise no less than two epoxy resins of bisphenol A type with different number-average molecular weights, wherein the number-average molecular weight of the low-molecular-weight component is 360~2000 and the number-average molecular weight of the high-molecular-weight component is 3000~10,000. It is further preferred that the content ratio of the low-molecular-weight component be 20~50 wt. % and that of the high-molecular-weight component be 5~40 wt % When the content ratio of the low-molecular-weight component is too high or the molecular weight thereof is less than 360, gloss becomes too strong and preservability can be degraded. Furthermore, if he content ratio of the high-molecular-weight component is too high or the molecular weight thereof is higher than 10,000, gloss is insufficient and fixability can be degraded.

Alkylene oxide adducts of diphenols are the preferred compounds comprising a polyalkylene group-containing portion, which are employed in accordance with the present invention. Specific examples include reaction products of ethylene oxide, propylene oxide, butylene oxide and mixtures thereof with bisphenols such as bisphenol A or bisphenol F. The adducts obtained may be glycidylated by epichlorohydrin or b-methyl epichlorohydrin.

The preferred alkylene oxide adducts of diphenols are diglycidyl ethers of alkylene oxide adducts of bisphenol A, which are represented by the General formula (1) below (1)

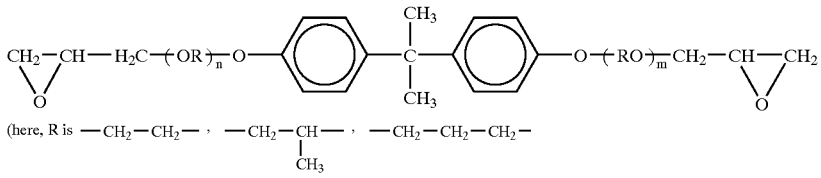

And n, m are repetition units, respectively greater than 1, and meets equation n+m=2~8)

Furthermore, it is preferred that the alkylene oxide adducts of diphenols or glycidyl ethers thereof are contained at a ratio of 10~40 wt % based on the polyol resin If the amount thereof is small, it leads to negative effects such as increase in curling. Moreover, if n+m is no less than 9 or the amount is too large, gloss becomes too strong or preservability can be degraded.

The binder resin of the toner can contain a compound having in a molecule thereof one active hydrogen atom reacting with an epoxy group. Examples of compounds having in a molecule thereof one active hydrogen atom reacting with an epoxy group include monophenols, secondary amines, and carboxylic acids. Examples of monophenols include phenol, cresol, isopropyl phenol, aminophenol, nonyl phenol, dodecyl phenol, xylenol, p-cuminylphenol, and the like. Examples of secondary amines include diethylamine, dipropylamine, dibutylamine, N-methyl(ethyl)piperazine, piperidine, and the like. Examples of carboxylic acids include propionic acid, capronic acid, and the like.

Various combinations of starting materials can be used to obtain the polyol resin comprising an epoxy resin portion and an alkylene oxide portion in the main chain in accordance with the present invention. For example, such a resin can be obtained by conducting a reaction of an epoxy resin terminated on both ends with glycidyl groups and alkylene oxide adducts of diphenols terminated on both ends with glycidyl groups with a dihalide or diisocyanate, diamine, dithiol, polyphenols, and dicarboxylic acids. Among them, from the standpoint of reaction stability, it is most preferred to conduct the reaction of diphenols. Furthermore, it is also preferred that polyphenols or polycarboxylic acids be used together with diphenols within a range causing no gelling The amount of polyphenols and polycarboxylic acids is 15% or less, preferably, 10% or less, based on the total amount The binder resin of the toner can contain a compound having in a molecule thereof two active hydrogen atoms reacting with an epoxy group. Examples of compounds having in a molecule thereof two or more active hydrogen atoms reacting with an epoxy group include diphenols, polyphenols, and polycarboxylic acids. Examples of diphenols include bisphenols such as bisphenol A or bisphenol F Examples of polyphenols include orthocresol novolaks, phenol novolaks, tris(4-hydroxyphenyl)methane, and 1-[-methyl-a-(4-hydroxyphenyl)ethyl]benzene. Examples of polycarboxylic acids include malonic acid, succinic acid, glutaric acid, adipic acid, maleic acid, fumaric acid, phthalic acid, terephthalic acid, trimellitic acid, and trimellitic anhydride.

Furthermore, it is preferred that the polyol resin further comprise a polyester portion at least in the main chain because the polyester component changes viscoelasticty and curability of the resin, making it possible to obtain a softer resin and suppress curling of the image.

Controlling the epoxy equivalent of the binder resin to no less than 10,000, such as 20,000 or more and preferably, no less than 30,000, and more preferably, to no less than 50,000, makes it possible to control thermal properties of the resin, to decrease the amount of low-molecular-weight epichlorohydrin which is a reaction residue, and to obtain toner with excellent stability and resin properties.

The epoxy equivalent was determined by an indicator titration method described in section 4.2 of JIS K7236.

Furthermore, it was found that the component soluble in polar solvents can be effectively removed and a resin suitable for a toner with a low content of components soluble in polar solvents can be obtained by using a manufacturing process in which water is added to a resin at least after or during the synthesis reaction, the reaction solvent and water are bubbled under reduced pressure and water, reaction solvent, and components soluble in polar solvents are evaporated. In this process, controlling the residual water concentration in the binder resin to 1% or less, preferably, 0.5% or less makes it possible to obtain a toner with excellent environmental stability. The weight concentration of components soluble in polar solvents can be made less than 1000 μg per 1 g of toner, for example, by using starting materials with higher purity for a charge control agent of the toner or for auxiliary additives, pigments, carrier resin, charge control agent, and the like The purity can be confirmed by various analytical methods such as column chromatography, HPLC, GPC, GC, or the like. As for the impurities from the manufacturing line, the production line can be maintained in a cleaner state by conducting frequent cleaning or overhaul and improving the efficiency of evacuation duct system, or the training of operators can be improved and the line can be used exclusively for the manufacture of toner of the same type.

From the standpoint of obtaining a master batch pigment with a small amount of components soluble in polar solvents it is preferred that in the manufacture of a master batch pigment having a pigment dispersed in a resin the above-described resin containing a small amount of components soluble in polar solvents and a pigment be heated and kneaded without using an organic solvent. Furthermore, it is preferred that a process be used comprising a step in which a dry powder pigment is used as the pigment, at least water is added when the dry powder pigment is mixed with the binder resin, and water is removed after the mixture is heated and kneaded. This is because such a step makes it possible to improve dispersibility of the resin and pigment and to obtain a master batch pigment with excellent color stability, transparency, and color reproducibility Furthermore, the weight concentration of components soluble in polar solvents in the master batch pigment per 1 gram is preferably 500 μg or less, more preferably, 100 μg or less, and still more preferably, 30 μg or less, based on the master batch pigment. In such case, the amount of components soluble in polar solvents in the manufacture of toner by using the master batch pigment is small and a master batch pigment with excellent color stability and transparency can be obtained.

When a carrier with a small amount of residual components soluble in polar solvents was mixed and stirred with the above-described toner, the weight concentration of the components soluble in polar solvents was 500 μg or less, based on the developer per 1 g, and a developer for electrophotographic toners with excellent charge stability was obtained.

Utilizing the above-described toner and developer with a low content of components soluble in polar solvents made it possible to obtain an image forming method and apparatus with excellent stability and little formation of components soluble in polar solvents under the effect of heat during fixing, even when the image fixing method used a contactless thermal fixing system having a large energy consumption and a large ratio of energy dissipation into environment.

Furthermore, a problem associated with a low-surface-pressure fixing system employing a roller with a thin coat layer or a low-temperature fixing system using a film or a belt, was that the toner could be fixed at a low temperature and, therefore, it was necessary to decrease the average molecular weight, and the content of low-molecular-weight components soluble in polar solvents easily increased However, regulating the amount of components soluble in polar solvents in the toner and developer makes it possible to obtain an image forming method and apparatus with excellent stability, without sacrificing the thermal properties of the toner.

As for the manufacturing method and material for the toner and developer used in accordance with the present invention, any conventional methods and materials can be employed, the components soluble in polar solvent requires to meet the prescribed amount.

(Penetration Depth)

The toner was weighed by 10 g, placed in a glass container with a capacity of 20 cc, and allowed to stay for 5 h in a thermostat set at 50° C. Then, the penetration depth was measured with a penetration meter.

(Colorant)

Any conventional dye or pigment can be used as the colorant of the toner in accordance with the present invention. Examples thereof include carbon black, nigrosine dyes, iron black, Naphthol Yellow S, HANSA YELLOW (10G, 5G, G), cadmium yellow, yellow iron oxide, yellow ocher, chrome yellow, titanium yellow, oil yellow, HANSA YELLOW (GR, A, RN, R), Pigment Yellow L, Benzidine Yellow (G, GR), Permanent Yellow (NCG), Vulcan Fast Yellow (5G, R), Tartarizine Lake, Quinoline Yellow Lake, Anthragen Yellow BGL, Isoindolinone Yellow, iron oxide red, lead red, lead scarlet, cadmium red, cadmium mercury red, antimony scarlet, Permanent Red 4R, Para Red, Fire Red, parachloroorthonitroaniline red, LITHOL FAST SCARLET G, Brilliant Fast Scarlet, Brilliant Carmine BS, Permanent Red (F2R, F4R, FRL, FRLL, F4RH), Fast Scarlet VD, Vulcan Fast Rubin B, Brilliant Scarlet G, LITHOL RUBIN GX, Permanent Red F5X Brilliant Carmine 6B, Pigment Scarlet 3B, Bordeaux 5B, Toluidine Maroon, Permanent Bordeaux F2K, Helio Bordeaux BL, Bordeaux 10B, Bon Maroon Light, Bon Maroon Medium, Eosine Lake, Rodamine Lake B, Rodamine Lake Y. Alizarine Lake, Thioindigo Red B, Thioindigo Maroon, Oil Red, Quinacridone Red, Pyrazolone red, Chrome Vermilion, Benzidine Orange, Perinone Orange, Oil Orange, Cobalt Blue, Cellurian Blue, Alkali Blue Lake, Peacock Blue Lake, Victoria Blue Lake, metal-free Phthalocyanine Blue, Phthalocyanine Blue, Fast Sky Blue, Indanthren Blue (RS, BC), Indigo, ultramarine, Prussian blue, Anthraquinone Blue, Fast Violet B, Methyl Violet Lake, Cobalt Violet, Manganese Violet, Dioxazine Violet, Anthraquinone Violet, Chrome Green, Zinc Green, chromium oxide, Pyridian Emerald Green, Pigment Green B, Naphthol Green B, Green Gold, Acid Green Lake, Malachite Green lake, Phthalocyanine Green, Anthraquinone Green, titanium oxide, zinc white, lithopone, and mixtures thereof.

The amount of colorant used is typically 0.1~50 wt. parts per 100 wt. parts of the binder resin. In order to control the amount of components soluble in polar solvents in the toner, it is preferred than the content of components soluble in polar solvents in the pigment or impurities contained in the pigment be also small.

(Charge Control Agent)

The toner in accordance with the present invention, if necessary, may contain a charge control agent. Any of the conventional charge control agents may be used for this purpose. Examples thereof include nigrosine dyes, triphenylmethane dyes, chromium-containing metal complex dues, molybdenic acid chelate dyes, rodamine dyes, alkoxyamines, quaternary ammonium salts (including fluorine-modified quaternary ammonium salts), alkyamides, phosphorus or compounds thereof, tungsten or compounds thereof, fluorine-containing active agents, metal salts of salicylic acid, metal salts of salicylic acid derivatives, and the like. Specific examples include BONTRON 03 which is a nigrosine dye, BONTRON P-51 which is a quaternary ammonium salt, BONTRON S-34 which is a metal-containing azo dye, E-82 which is a metal complex based on oxynaphthoic acid, E-84 which is a metal complex based on salicylic acid, and E-89 which is a phenol condensate (all of them are manufactured by Orient Chemical Industries Co., Ltd.), TP-302, TP-415 which are molybdenum complexes of quaternary ammonium salts (both are manufactured by Hodogaya Chemical Co.), COPY CHARGER PSY VP2038 which is a quaternary ammonium slat, COPY BLUE PR which is a triphenylmethane derivative, COPY CHARGER NEGVP2036 which is a quaternary ammonium salt, and COPY CHARGER NX VP434 (all of them are manufactured by Hoechst Co.), LRA-901, LR-147 which is a boron complex (manufactured by Japan Carlit Co.), copper phthalocyanine, perilene, quinacridone, azo dyes, and macromolecular compounds having functional groups such as sulfonic acid group, carboxyl group, quaternary ammonium group, and the like.

The amount of the charge control agent used in accordance with the present invention is determined by the type of the binder resin, optionally used additives, and toner manufacturing method including the dispersing method and cannot be limited by a specific range. It is, however preferred that this amount be within a range of 0.1~10 wt parts per 100 wt. parts of binder resin. A range of 2~5 wt. parts is even more preferred. If this amount exceeds 10 wt. parts, the toner charging ability becomes too high, the effect of the main charge control agent is decreased, electrostatic attraction to the development roller is increased, flowability of the developer is reduced, and the image density is decreased.

Certain types of charge control agents contain a large amount of components soluble in polar solvents in the main components or in impurities. It is, however, preferred that a charge control agent with a low content of components soluble in polar solvents be used as a starting material, thereby decreasing the amount of components soluble in polar solvents in the toner.

(Auxiliary Additives)

The toner in accordance with the present invention, if necessary, may contain auxiliary additives. Fine inorganic particles or fine inorganic particles subjected to hydrophobization can be used as the auxiliary additives. Any of the conventional particles of this type can be used. Examples of such auxiliary additives include colloidal silica, hydrophobized silica, metal salts of aliphatic acids (zinc stearate, aluminum stearate, and the like), metal oxides (titania, alumina, tin oxide, antimony oxide and the like), fluoropolymers, and the like.

Examples of especially preferred auxiliary additives include hydrophobized fine particles of silica, titania, and alumina. Examples of fine silica particles include HDK H 2000, HDK H 2000/4, HDK H 2050EP, HVK21 (all of them are manufactured by Hoechst Co) and R972, R974, RX200, RY200, R202, R805, R812 (all of them are manufactured by Nippon Aerosil K. K.). Examples of fine titania particles include P-25 (manufactured by Nippon Aerosil K. K.), STT-30, STT-65C-S (both are manufactured by Titan Kogyo K. K.), TAF-140 (manufactured by Fuji Titan Kogyo K. K.), and MT-150W, MT-500B, MT-600B (all of them are manufactured by Teika K. K.).

Examples of fine particles of titanium oxide subjected to hydrophobization include T-805 (manufactured by Nippon Aerosil K. K.), STT-30A, STT-65S-S (both are manufactured by Titan Kogyo K. K.), TAF-500T, TAF-1500T (both are manufactured by Fuji Titan Kogyo K. K.), MT-100S, MT-100T, (both are manufactured by Teika K. K.), and IT-S (manufactured by Ishihara Sanyo K. K.).

In order to obtain hydrophobized fine particles of silica, titania, and alumina, the hydrophilic fine particles can be treated with a silane coupling agent such as methyltrimethoxysilane, methyltriethoxysilane, octyltrimethoxysilane, and the likes. Fine inorganic particles treated with a silicone oil, which are prepared by treating fine inorganic particles with an optionally heated silicone oil are especially preferred.

Examples of silicone oils include dimethyl silicone oil, methylphenyl silicone oil, chlorophenyl silicone oil, methylhydrogen silicone oil, alkali-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl (methacryl)-modified silicone oil, a-methylstyrene-modified silicone oil, and the like.

Example of fine inorganic particles include silica, alumina, titanium oxide, titanium dioxide, barium titanate, magnesium titanate, calcium titanate, strontium titanate, iron oxide, copper oxide, zinc oxide, tin oxide, silica sand, clay, mica, wollastonite, diatomite, chromium oxide, cerium oxide, pergara, antimony trioxide, magnesium oxide, zirconium oxide, pariumu sulfate, barium carbonate, calcium carbonate, silicon carbonate, silicon nitride, and the like. Among them, silica and titanium dioxide are especially preferred.

The average diameter of primary particles of the fine inorganic particles is 100 nm or less, preferably, 3 nm or less and 70 nm or less. When the average diameter is below this range, the fine inorganic particles are buried in the tonier and the function thereof cannot be demonstrated effectively Furthermore, when the average diameter is above this range, the photoconductor surface is non-uniformly scratched, which is undesirable. The average diameter of particles as referred to hereinabove is a number-average diameter of particles.

The diameter of fine inorganic particles used in accordance with the present invention can be measured with an apparatus for measuring the particle size distribution which employs dynamic light scattering, for example, with an apparatus DLS-700 manufactured by Otsuka Electronics Co, Ltd. or apparatus Colter N4 manufactured by Colter Electronics Co, Ltd. However, since it is difficult to avoid secondary cohesion of particles subjected to hydrophobization, it is preferred that the diameter be directly determined from a photography obtained with a scanning or transmission electron microscope. In this case, no less than 100 fine inorganic particles are observed, and the average value of their large diameter is determined.

In order to decrease the amount of components soluble in polar solvents in the toner, it is preferred that a charge control agent with a small content of components soluble in polar solvents be also used in the auxiliary additives The amount thereof which is added can be from 0.1 to 5 wt %, preferably, from 0.3 to 3 wt. %, based on the weight of the toner.

(Carrie)

When the toner in accordance with the present invention is used in a two-component developer, it may be used in a mixture with a magnetic carrier The content ratio of the carrier and toner in the developer is preferably 1~10 wt. parts of the toner per 100 wt. parts of the carrier. Conventional magnetic carriers such as iron powder, ferrite powder, magnetite powder, magnetic resins carriers, and the like with a particle diameter of about 20~200 mm can be used for this purpose, When a carrier coated with a resin is used, it is more preferred that the amount of residual solvent in the coating resin or the amount of volatile components introduced by impurities be decreased by changing the coating conditions (drying temperature, drying time, atmosphere).

Examples of coating materials include amino resins, for example, urea-formaldehyde resin, melamine resin, benzoguanamine resin, urea resin, polyamide resins, epoxy resins, and the like. Other examples include polyvinyl and polyvinylidene resins, for example, acryl resins, poly (methyl methacrylate) resin, polyacrylonitrile resin, poly (vinyl acetate) resin, poly(vinyl alcohol) resin, poly(vinyl butyral) resin, polystyrene-based resins such as polystyrene resin and styrene-acryl copolymer resin, halogenated olefin resins such as poly(vinyl chloride), polyester resins such as poly(ethylene terephthalate) resin and poly(butylene terephthalate) resin, polycarbonate resins, polyethylene resin, poly(vinyl fluoride) resin, poly(vinylidene fluoride) resin, polytrifluoroethylene resin, polyhexafluoropropylene resin, copolymer of vinylidene fluoride and acryl monomer, copolymer of vinylidene fluoride and vinyl fluoride, fluoroterpolymers such as terpolymers of tetrafluoroethylene, vinylidene fluoride, and non-fluorinated monomers, and silicone resins.

Furthermore, if necessary, electrically conductive powder may be introduced into the coating resin. Metal powders, carbon black, titanium oxide, tin oxide, zinc oxide, and the like may be used as the electrically conductive powders. The average particle size of those electrically conductive powders is preferably 1 mm or less. If the average particle size is more than 1 mm, the electric resistance is difficult to control., The toner in accordance with the present invention may be also used as a one-component magnetic toner using no carrier or as a non-magnetic toner.

(Wax)

A wax is preferably introduced into the toner or developer to provide it with releasability. The wax preferably has a melting point of 40~120° C., especially, 50~110° C. When the wax melting point is too high, fixability at a low temperature sometimes becomes insufficient. On the other hand, if the melting point is too low, then anti-offset performance and durability are sometimes decreased. Furthermore, the melting point of the wax can be measured by differential scanning calorimetry (DSC). Thus, a melting peak value obtained when several milligrams of a sample is heated at a constant temperature rise rate, for example, 10° C./min, is considered as a melting point. The wax content is preferably 0~20 wt. parts, even more preferably, 0~10 wt. Parts, in respect to 100 wt. parts of toner Examples of waxes that can be used in accordance with the present invention include solid paraffin waxes, microwax, rice wax, waxes based on aliphatic acid amide, aliphatic acid waxes, aliphatic monoketones, waxes based on metal salts of aliphatic acids, waxes based on aliphatic acid esters, waxes based on partially saponified aliphatic acid esters, silicone wax, higher alcohols, carnauba wax, and the like. Furthermore, polyolefins such as low-molecular weight polyethylene, polypropylene, and the like can also be used. Polyolefins with a softening point (determined by a ring and ball method) of 70~150° C., especially, 120~150° C. are particularly preferred.

It is preferred that a cleaning ability improving agent serving to remove the developer remaining on the photoconductor or a primary transfer medium be introduced into the toner or added to the toner surface, or introduced into the developer or added to the surface thereof. Examples of cleaning ability improving agents include metal salts of aliphatic acids such as zinc stearate, calcium stearate, stearic acid, and the like, and fine polymer particles manufactured by soap-free emulsion polymerization, such as fine particles of poly(methyl methacrylate), fine particles of polystyrene, and the like. It is preferred that the fine polymer particles have a comparatively narrow particle size distribution and a volume-average particle size of from 0.01 to 1 mm. The content of the cleaning ability improving agent is preferably 0~5 wt. parts, more preferably, 0~1 wt. part, in respect to 100 wt. parts of toner.

(Magnetic Material)

Furthermore, the toner in accordance with the present invention can contain a magnetic material and be used as a magnetic toner. When it is used as a magnetic toner, fine particles of a magnetic material may be introduced into the toner particles. Examples of suitable magnetic materials include metals demonstrating ferroelectric properties, such as iron mainly in the form of ferrite and magnetite, nickel, cobalt, and the like, compounds containing those elements, alloys which contain non-ferroelectric elements but demonstrate ferroelectric properties when subjected to an appropriate heat treatment, for example, the so-called Heusler alloys which contain manganese and copper, e.g, manganese-copper-aluminum alloys, manganese-copper-tin alloys, and the like, chromium dioxide, and the like. The magnetic material is preferably introduced by homogeneously dispersing it in the form of a fine powder with an average particle size of 0~1 mm The content ratio of the magnetic material is preferably 10~70 wt. parts, especially, 20–50 wt. parts per 100 wt. parts of the toner obtained.

(Method for Manufacture of Toner)

A method for the manufacture of a toner comprising the steps of mechanically mixing a developer components including at least a binder resin, a main charge control agent, and a pigment, melt kneading, grinding, and classifying can be used as the toner manufacture method in accordance with the present invention. A manufacturing method can be also used in which a powder other than the particles serving as a product, which are obtained in the grinding or classifying process, are returned and reused in the mechanical mixing or melt kneading process.

A powder (byproducts) other than the particles serving as a product which is referred to herein means fine or coarse particles other than the components of the product with a desired particle size which are obtained in a grinding process after the melt kneading process or fine or coarse particles other than the components of the product with a desired particle size which are produced in the subsequently conducted classification process. Such byproducts are preferably mixed with the starting materials in the mixing process or melt kneading process, preferably at a weight ratio of 1 part of the byproduct per 99 parts of other starting materials to 50 parts of the byproduct per 50 parts of other starting materials.

No limitation is placed on the mixing process and the toner components comprising at least a binder resin, a main charge control agent, a pigment, and a byproduct may be conducted under usual conditions by using a usual mixing apparatus comprising rotary vanes.

Once the above-described mixing process has been completed, the mixture is charged into a kneader where it is melt kneaded. Single- or twin-screw continuous kneaders or batch kneaders using a roll mill can be used as the melt kneaders Examples of the preferred apparatuses include a KTK-type twin-screw extruder manufactured by Kobe Steel Co, Ltd., a TEM-type extruder manufactured by Toshiba Kikai K. K., a twin-screw extruder manufactured KCK Co, a PCM-type twin-screw extruder manufactured by Ikegai Tekkosho K. K., and a kneader manufactured by Buss Co.

It is important that the melt kneading be conducted under appropriate conditions such as to prevent breakage of molecular chains of the binder rein. More specifically, the melt kneading temperature should be set by taking into account the softening point of the binder resin. If the melt kneading temperature is too low by comparison with the softening point, the molecular chains are intensively broken, and if the kneading temperature is too high, dispersing cannot proceed Furthermore, when the amount of volatile components and components soluble in polar solvent in the toner are controlled, it is preferred that optimum conditions relating to the melt kneading time, temperature, and atmosphere be set, while monitoring the amount of residual volatile components and components soluble in polar solvent at this time.

Once the above-described melt kneading process has been completed, the kneaded product is ground. It is preferred, that in the grinding process, first, coarse grinding and then fine grinding be conducted. It is also preferred that grinding be conducted by using a system in which impacts are provided by an impact plate in a jet air flow or by a system in which grinding proceeds in a narrow gap between a mechanically rotated rotor and a stator.

Once the grinding process has been completed, the ground product is classified in a gas flow by a centrifugal force or the like. As a result, a toner with the prescribed particle size, for example, an average particle size of 5~20 mm is manufactured When toner is prepared, fine inorganic particles such as the above-described fine hydrophobic silica particles may be added to and mixed with the toner manufactured in the above-described manner in order to improve flowability, preservability, developability, and transferability of the developer. A usual powder mixer can be used for mixing the auxiliary additives, but it is preferred that the mixer be equipped with a jacket for adjusting the internal temperature. The auxiliary additives may be added in the process or gradually in order to change the history of load applied to the auxiliary additives. It goes without saying, that the mixer rpm, rotation speed, time, and temperature may be varied First, a high load and then a comparatively small load may be applied, or vice versa.

Examples of mixing equipment that can be used include V-type mixers, rocking mixers, Leydig mixer, Nauter mixer, Henschel mixer, and the like.

<Master Batch Pigment>

The master batch pigment in accordance with the present invention is suitable for a toner for electrostatic image development and has a pigment dispersed in a resin for a toner comprising at least an epoxy resin portion and a polyalkylene group-containing portion in the main chain.

It is preferred that the master batch pigment in accordance with the present invention be manufactured by heating and mixing the resin with a low content of components soluble in polar solvents and a pigment, without using an organic solvents, because such a process makes it possible to obtain a master batch pigment with excellent 0environmental charge stability. Furthermore, the dispersibility can be further improved by using a dry powder pigment and utilizing water in a method of wetting with a resin. Moreover, better environmental charge properties during toner manufacture can be obtained if the weight concentration of components soluble in polar solvents is 500 $\mu$g/g or less, preferably, 300 $\mu$g/g or less, more preferably, 100 $\mu$g/g or less, still more preferably, 30 $\mu$g/g or less, based on the master batch pigment.

Organic pigments employed as colorants are typically hydrophobic. However, because they undergo water washing and drying in the manufacture thereof water can permeate inside the pigment aggregates if a certain force is applied If a mixture of a resin and such pigment in which water has permeated inside the aggregate is kneaded at a set temperature of no less than 100° C. in an open-type kneader, water present inside the aggregate instantaneously reaches a boiling point and its volume is increased. As a result, a force trying to break the aggregate is applied from inside thereof. Such a force acting from inside of the aggregate can break the aggregate much more efficiently than the force applied from the outside. Furthermore, since at this time the resin is heated to a temperature of no less than the softening point, the viscosity thereof decreases and it can wet the aggregate with good efficiency At the same time, water which is at a temperature close to the boiling temperature inside the aggregate is replaced with the resin by the effect similar to flushing. As a result, a master batch pigment can be obtained in which the pigment is dispersed in a state close to that of primary particles. An additional effect is that since in the process of water evaporation the evaporation heat generated owing to water evaporation is released from the kneaded product, the temperature of the kneaded product is at a relatively low level of 100° C. or less and a high viscosity is maintained As a result, a shear force is effectively applied to the pigment aggregates.

Usual two-roll mixers, three-roll mixers, and also Banbury mixers employed in an open mode, or a two-roll continuous kneader manufactured by Mitsui Kozan K. K. can be used as open-type kneaders for the manufacture of the master batch pigment used in accordance with the present invention.

<Resin for Toner>

The resin for toner in accordance with the present invention is employed as a binder resin of a toner for electrostatic image development and comprises an epoxy resin portion and a polyalkylene group-containing portion at least in the main chain.

Using such a resin for a toner makes it possible to obtain a toner with environmental stability and stable fixing properties, this toner preventing the transition of a toner image onto a sheet of vinyl chloride resin when the surface of the copy fixed image is brought in intimate contact with the sheet In particular, when the resin is used in a color toner, good color reproducibility and stable gloss are obtained and curling of the copy fixed image is prevented.

In order to remove components soluble in polar solvents, residual solvent, unreacted monomers, volatile components, water, and the like with higher efficiency, it is preferred that the resin for a toner in accordance with the present invention be manufactured by a process comprising the steps of adding water to the resin at least after the synthesis reaction or during the synthesis reaction, bubbling of the reaction solvent and water under reduced pressure, and evaporating the water, reaction solvent, volatile components, and components soluble in polar solvents. It is even more preferred that in this process, the residual concentration of water in the resin be 1% or less, more preferably, 0 5% or less, which provides for even better environmental charge properties during toner manufacture.

<Image Forming Method and Image Forming Apparatus>

An image forming method in accordance with the present invention comprises a latent electrostatic image formation process in which a latent electrostatic image is formed on a latent electrostatic image bearing member and a development process in which a toner image is formed by developing the latent electrostatic image with an electrostatic image developer contained in a developing apparatus, composed of at least a binder resin and a colorant, and comprising components soluble in polar solvents at 1000 $\mu$g/g or less. The image forming apparatus in accordance with the present invention comprises a latent electrostatic image bearing member, latent electrostatic image forming means for forming a latent electrostatic image on the latent electrostatic image bearing member, and developing means for forming a toner image by developing the latent electrostatic image, the developing means enclosing an electrostatic image developer composed of at least a binder resin and a colorant and comprising components soluble in polar solvents at 1000 $\mu$g/g or less. The image forming method and image forming apparatus in accordance with the present invention can employ any fixing system, but an especially desirable effect can be demonstrated when they employ the below-described fixing system.

(Contactless Fixing System)

In accordance with the present invention, a greater effect is produced if the fixing system is a contactless thermal fixing system, for example, an oven fixing or flash fixing system. Thus, image forming method and apparatus with excellent safety and a low amount of volatile components released under beating at the time of fixing are obtained by using the toner and developer with a small amount of volatile components and components soluble in polar solvents, even when a contactless thermal fixing system is used which has a high power consumption and a large ratio of energy dissipated into environment. With the contactless fixing system, the smoothness of the image surface is often insufficient, and when fixing at a lower temperature is desired, it is even more preferred that a method of passing a fixed image between the heated rollers and increasing the image gloss be used in combination with such fixing system (Film Fixing)

In accordance with the present invention a greater effect is produced with a fixing system comprising a fixing method by which a toner image is thermally fixed on a recording material with a stationary heating body and a pressure part which is in pressure contact with the heating body and rotates with respect thereto, this pressure part pressing the recording material against the heating body via a film material. Thus, the problem associated with a low-temperature fixing system using a film or belt was that the average molecular weight of the toner had to be decreased to allow for a low-temperature fixing, which inevitably easily led to increased content of low-molecular-weight volatile components and components soluble in polar solvents. Controlling the amount of volatile components and components soluble in polar solvents in the toner and developer made it possible to obtain the image forming method and apparatus with excellent safety, without sacrificing the thermal properties of the toner.

No specific limitation is placed on the fixing film material used in accordance with the present invention, and thin films with a thickness of 100 mm or less, preferably, 50 mm or less which have high heat resistance, releasability, and endurance can be used for this purpose. Monolayer or multilayer films of the following materials can be used as the filing films. Thus, heat-resistant resins, for example, fluororesins such as polyester tetrafluoroethylene polymer, and at least ethylene-tetrafluoroethylene ethylene copolymer, tetrafluoroethylene-hexafluoropropylene copolymer, tetrafluoroethylene-perfluoroalkylvinyl ether copolymer, tetrafluoroethylene-hexafluoropropylene-perfluoroalkylvinyl ether copolymer, and the like with polyimido, polyetherimido can be used for the monolayer films. Examples of multilayer films include films in which a releasable coat layer having an electrically conductive material added thereto is coated to a thickness of 5~15 mm on PTFE polytetrafluoroethylene) at least on the surface which is to be in contact with the image.

A finned body with a low thermal capacity is preferably used as the heating body fixedly installed on the apparatus frame For example, a resistance material is coated to a thickness of 1.3 mm on an alumina substrate having a thickness of 0.2~5.0 mm, preferably, 0.5~3.5 mm, a width of 10~15 mm, and a length in the longitudinal direction of 240 mm and an electric current is passed from both ends thereof The electric current is passed, for example, in the form of DC 100 V pulses with a period of 25 ms, the pulse width being changed according to the temperature and energy release amount controlled with a temperature sensor. In the finned heating body with a low thermal capacity, the surface temperature T2 of the film material facing the resistance material becomes lower than the temperature T1 detected by the temperature sensors Here, T1 is preferably 140~200° C. and T2 is preferably by 0.5~1.0° C. lower than T1. Furthermore, the film surface temperature T3 in the zone where the film material is peeled from the toner fixing surface is almost equal to T2.

The film is driven by a drive roller and an idle roller and is transported under tension so as to prevent wrinkling and twisting The pressure roller having an elastic layer of a rubber having high releasability; such as silicone rubber, is pressed against the heating body via the film under a total pressure of 2~30 kg and is rotated in pressure contact therewith. A schematic structure illustrating an embodiment of the fixing apparatus used in the above-described fixing method is shown in FIG. 1. In FIG. 1, the reference numeral 4 stands for a fixedly installed heating body comprising an alumina substrate 5 coated with a resistance material and a temperature sensor 6. The temperature is detected with the temperature sensor 6, and the temperature of alumina substrate and the amount of released energy are controlled by a control mechanism (not shown in the figures). The reference numeral 2 stands for an endless film, 1—driving roller which drives the film 2, 3—idle roller, and 8—pressure roller pressing the recording material to the beating body 4 via the film 2. The reference numeral 7 stands for a guide plate guiding the recording material into the fixing apparatus. The recording material (transfer paper such as ordinary paper) having a toner image moves in the direction of arrow K so that the toner image is in contact with the surface of film material 2 and is fed into the fixing apparatus and fixed, (Low-surface-pressure Fixing)

In accordance with the present invention, a greater effect is produced with an image forming method by which fixing is conducted by passing between two rolls to cause heating and melting, wherein the thickness of the fixing roller at the side which is in contact with the toner image support surface is 0.7 mm or less and the surface pressure (roller load divided by contact surface area) applied between the two rollers is $1.5\times10^5$ Pa or less. Thus, the problem associated with such low-surface pressure fixing system was that the average molecular weight of the toner had to be decreased to allow for a low-pressure fixing, which inevitably easily led to increased content of low-molecular-weight volatile components and components soluble in polar solvents. However, controlling the amount of volatile components and components soluble in polar solvents in the toner and developer made it possible to obtain the image forming method and apparatus with excellent safety, without sacrificing the thermal properties of the toner. A schematic structure illustrating an embodiment of the fixing apparatus used in the above-described fixing method is shown in FIG. 2. In FIG. 2, the reference numerals 21 and 22 stand for a fixing roller and pressure roller, respectively. In the fixing roller 21, an offset-preventing layer 24, for example, from RTV, silicone rubber, tetrafluoroethylene-perfluoroalkylvinyl ether (PFA), or polytetrafluoroethylene (PTFE) is coated on the surface of metal cylinder 23 composed of a material with a high thermal conductivity, such as aluminum, iron, stainless steel, or brass. A heating lamp 25 is disposed inside the fixing roller 21. The metal cylinder 26 of the pressure roller 22 is most often made of the same material as the fixing roller 21 and the surface thereof is coated with a layer 27 of an offset-preventing material such as PFA, PTFA, and the like. A heating lamp 28 is installed inside the pressure roller 22, but this is not mandatory. The fixing roller and pressure roller are rotated under a pressure applied by springs from both ends thereof (not shown in the figure). Fixing is conducted by passing the recording material S (for example, a transfer paper such as ordinary paper) with a toner image T between the fixing roller 21 and pressure roller 22.

Embodiments

The present invention will be described below in greater detail with reference to embodiments thereof and comparative examples. The present invention is, however, not limited to those embodiments. Furthermore, in the embodiments and comparative examples below, parts and percents are weight parts and percents, unless stated otherwise The characteristics obtained and evaluation results are shown in Table 1 below. The evaluation in the embodiments was conducted in the following manner.

(Evaluation Machines)

Images used for evaluation were evaluated by using any of the below-described evaluation machines A, B, C, D, E, F.

(Evaluation Machine A)

Evaluation was conducted by using an evaluation machine A obtained by modifying a full-color laser copier (IMAGIO COLOR 2800), manufactured by Ricoh Co., in which a four-color development unit operated by developing each color with two-component developers on one drum-shaped photoconductor, successively transferring the colors onto an intermediate transfer medium, and transferring the four colors together onto a transfer paper.

(Evaluation Machine B)

Evaluation was conducted by using an evaluation machine B obtained by modifying a full-color laser copier (IPSiO 5000), manufactured by Ricoh Co., in which a four-color development unit operated by developing colors successively on one belt-like photoconductor with non-magnetic one-component developers, successively transferring the colors onto an intermediate transfer medium, and transferring the four colors together onto a transfer paper.

(Evaluation Machine C)

Evaluation was conducted by using an evaluation machine C obtained by modifying a full-color LED printer (GL8300), manufactured by Fujitsu Co., this printer employing a tandem system which had a nonmagnetic one-component development unit for four colors and a photoconductor for four colors and successively transferring the colors onto a paper.

(Evaluation Machine D)

Evaluation was conducted by using an evaluation machine D which was DCP32D, manufactured by XEICON Co, an electrophotographic full-color on-demand machine containing a contactless fixing system. Image evaluation was conducted by setting an oven fixing temperature to 140° C. and a printing speed to 15 copies (A4) per minute and 35 copies (A4) per minute.

(Evaluation Machine E)

Evaluation was conducted by using an evaluation machine B which was obtained by replacing a fixing unit of Ricoh copier MF200 with a fixing apparatus shown in FIG. 1 which used a fixing method by which, after the development process using a developer and a transfer process, a toner image was thermally fixed on a recording medium by means of a fixedly installed heating body and a pressure part which was pressed against the heating body and rotated with respect thereto and which pressed the recording material against the heating body via a film material (Evaluation Machine F)

A copying test was conducted by using as a low-surface-pressure fixing machine an apparatus (evaluation machine D) obtained by modification of the fixing unit of Ricoh copier ME-200 that used a Teflon roller for a fixing roller and setting Ricoh 6200-type paper into the apparatus. A fixing method was employed in which the toner image formed on a transfer material was passed between two rollers, thermally melted, and fixed. A fixing apparatus was used (see FIG. 2) in which the thickness of the fixing roller at the side which was in contact with the toner image support surface was 0.5 mm and the surface pressure (roller load divided by contact surface area) applied between the two rollers was $1.2\times10^5$ Pa.

(Evaluation Items)

1) Amount of Components Soluble in Polar Solvents

The amount of components soluble in polar solvents in the toner was shown. In case of four-color toners, the maximum value thereof was shown.

2) Image Density

A beta image was image output on Ricoh 6000-type paper and the image density was measured with X-RITE (manufactured by X-Rite Co.). The measurements were conducted independently for four colors and an average value was determined Symbol X represents a case when the value is less than 1.2, symbol Δ represents a case when the value is no less than 1.2 and less than 1.4, symbol ○ represents a case when the value is no less than 1.4 and less than 1.8, and symbol ◎ represents a case when the value is no less than 1.8 and less than 2.2.

3) Spent

An image chart with a 7% image area was output by running 100,000 copies in a single-color mode and the spent component adhered to the developer or development sleeve was evaluated. The best case in which the amount of spent was small was represented by symbol ◎, a good case with a small amount of spent was represented by symbol ○, a case with a larger amount of spent was represented by symbol Δ, and a case with a large amount of spent was represented by symbol X.

4) Heat Resistance Preservability

A total of 10 g of the toner of each color was weighed and placed in a glass container with a capacity of 20 cc The glass bottles were tapped about 100 times and allowed to stay for 24 h in a thermostat set to 50° C. Then, the penetration was measured with a penetration meter The results were represented by the following symbols, starting from the good ones, ◎: no less than 20 mm, ○, no less than 15 mm and less than 20 mm, Δ, no less than 10 mm and less than 15 mm, x: less than 10 mm.

5) Transparency

Fixing for each separate color was conducted at an image density of 1.0 mg/cm$^2$ and fixing temperature 150° C. on an OHP sheet and measurements were conducted with a Direct Haze Computer HGM-2DP manufactured by Suga Shikenki K. K. The results were represented by symbols according to the amount of haze degree, namely ◎ for haze degree less than 15, ○ for haze degree 15 or greater and less than 25, Δ for haze degree 25 or greater and less than 35, and X for haze degree 35 or greater.

6) Color Brightness and Color Reproducibility

Color brightness and color reproducibility were evaluated by visual observations of images output on Ricoh 6000-type paper. The results were determined by prescribed boundary samples and represented by the following symbols ◎○ΔX. ◎; color brightness recognized by every person, color reproducibility confirmed. ○; Color brightness recognized at a level indistinct of difference from a distance, color reproducibility confirmed. Δ; minimum color brightness and color reproducibility allowed in publication to withstand visual observation, X; color brightness and color reproducibility unacceptable for commercial item.

7) Gloss

Images output on Ricoh 6000-type paper were measured with a glossiness meter (VG-1D) (manufactured by Nippon Denshoku K. K.). The measurements were conducted by matching the projection angle and light reception angle with 60°, setting an S, S/10 switch SW to S, and setting standard conditions by using 0 adjustment and a reference plate. The results were represented as follows in order of decreasing glossiness. ◎: no less than 20, ○ no less than 10 and less than 20, Δ no less than 5 and less than 10, X. less than 5

8) Curliness of Image Paper

Images were output on Ricoh 6000-type paper and curliness of the output image paper was evaluated. Especially good results with no curling were represented by symbol ◎, good ones were represented by symbol ○, and poor results relating to curled paper were represented by symbol X.

9) Environmental Charge Stability

An image chart with a 7% image area was output by running 30,000 copies in a single-color mode in an environment with a temperature of 40° C. and a humidity of 90%. In this process, a part of the developer was sampled for every 1000 copies, the amount of charge was measured by a blow-off method, and the charge stability was evaluated. The results were represented by symbols ◎, ○, Δ, X. The Symbols ◎, ○, Δ, X denote the decrease in the electric charge in increasing order of magnitude The decrease or increase in the amount of electric charge, as compared with the initial amount of electric charge, which is within 10% is denoted by ⊕, within 20% —by ○, within 40% —by Δ, and the greater decrease or increase is denoted by X.

10) Fixability

◎: a level with extremely small fixing troubles and completely satisfactory results ○: a generally satisfying level. Δ, a level hardly satisfactory for a commercial product. X: a level absolutely unacceptable for a commercial product. The fixability was considered good when the fixing lower limit temperature and fixing upper limit temperature of the toner were fully within the fixing temperature range, no hot offset or cold offset has occurred, and no transportation troubles such as paper jam have occurred.

11) Resistance to Vinyl Chloride Sheet

Images were output on Ricoh 6000-type paper and then a preservability test was conducted by bringing the paper in intimate contact with a vinyl chloride sheet and allowing to stay for 180 h at normal temperature. Transition of the image onto the vinyl chloride sheet was evaluated. A case in which a toner image was partially or completely peeled when the sheet was separated from the image paper, and the sheet was also contaminated was represented by symbol x and a case when such development did not occur and the image had high resistance to vinyl chloride sheet was represented by symbol ○.

(Embodiment 1)

(Epoxy Polyol Resin 1)

A total of 378.4 g of low-molecular-weight epoxy resin of bisphenol A type (number-average molecular weight: about 360), 86.0 g of high-molecular-weight epoxy resin of bispbenol A type (number-average molecular weight: about 2700), 191.0 g of compound represented by general formula 1 of propylene oxide adduct bisphenol A type [in the General Formula (1) presented above, n+m is about 2.1], 274.5 g of bisphenol F, 70.1 g of p-cuminylphenol, and 200 g of xylene were placed in a separable flask equipped with a stirrer, a thermometer; an $N^2$ inlet opening, and a cooling tube. The temperature was raised to 70~100° C. under $N_2$ atmosphere, followed by the addition of 0.183 g of lithium chloride. Then, the temperature was raised to 160° C., water was added under reduced pressure, and water, xylene, other volatile components, and components soluble in polar solvents were removed by bubbling of water and xylene. Polymerization was conducted for 6~9 h at a reaction temperature of 180° C. and 1000 g of polyol resin was obtained, the resin having Mn. 3800, Mw/Mn. 3 9, Mp: 5000, a softening point of 109° C., Tg 58° C., and an epoxy equivalent of no less than 30,000 (it will be referred to as epoxy polyol resin 1 hereinbelow). In the polymerization reaction, the reaction conditions were controlled so that no monomer components remained. Polyalkylene group-containing portion in the main chain was confirmed by NMR. The weight concentration of components soluble in polar solvents in the resin was 55 μg with respect to 1 g of the resin.

(Toner manufacture)

[Black toner]

| | |
|---|---|
| Water | 1000 parts |
| Water cake containing phthalocyanine green (content of solids 30%) | 200 parts |
| Carbon black (MA60 manufactured by Mitsubishi Chemicals Co., Ltd.) | 540 parts |
| Epoxy polyol resin 1 | 1200 parts |

The above-described starting materials were mixed in a HENSCHEL MIXER and a mixture was obtained in which water was infiltrated into a pigment aggregate. The mixture was kneaded for 45 min with two rolls having a roll surface temperature set to 130° C., rolled, cooled, and ground in a pulverizer to obtain a master batch pigment. Then, the following materials

| | |
|---|---|
| Epoxy polyol resin 1 | 100 parts |
| The above-mentioned master batch pigment | 8 parts |
| Charge control agent (BONTRON E-84, manufactured by Orient Chemical Co, Ltd.) | 2 parts |

were mixed in a mixer and melt kneaded with a two-roll mill. The kneaded product was rolled and cooled. Then, colored particles of black color having a volume-average particle size of 8.5 mm were obtained by employing a grinder of an impact plate type based on a jet mill (I-type mill, manufactured by Japan Pneumatic Co., Ltd.) and a wind force classification employing a rotating flow (DS classifier, manufactured by Japan Pneumatic Co., Ltd.). A total of 0.5 wt. % hydrophobic silica (H2000, Clariant Japan Co.) was then added, followed by mixing in a HENSCHEL MIXER. The mixture was passed through a sieve with a mesh size of 50 mm to remove the aggregates and obtain a black toner 1. The melt viscosity of the toner at a temperature of 140° C. was 96 mPas·sec.

[Yellow toner]

| | |
|---|---|
| Water | 600 parts |
| Water cake containing Pigment Yellow 17 (content of solids 50%) | 1200 parts |
| Epoxy polyol resin 1 | 1200 parts |

The above-described starting materials were mixed in a HENSCHEL MIXER and a mixture was obtained in which water was infiltrated into a pigment aggregate. The mixture was kneaded for 45 min with two rolls having a roll surface temperature set to 130° C., rolled, cooled, and ground in a pulverizer to obtain a master batch pigment. Then, the following materials

| | |
|---|---|
| Epoxy polyol resin 1 | 100 parts |
| The above-mentioned master batch pigment | 8 parts |
| Charge control agent (BONTRON E-84, manufactured by Orient Chemical Co, Ltd.) | 2 parts |

were mixed in a mixer and melt kneaded with a two-roll mill. The kneaded product was rolled and cooled. Then, grinding and classification were conducted in the same manner as in the example of the manufacture of black colored particles, and colored particles of yellow color having a volume-average particle size of 8.5 mm were obtained. A total of 0.5 wt. % hydrophobic silica (H2000, Clariant Japan Co.) was then added, followed by mixing in a HENSCHEL MIXER. The mixture was passed through a sieve with a mesh size of 50 mm to remove the aggregates and obtain a yellow toner 1. The melt viscosity of the toner at a temperature of 140° C. was 98 mPas·sec.

[Magenta toner]

| | |
|---|---|
| Water | 600 parts |
| Water cake containing Pigment Red 57 (content of solids 50%) | 1200 parts |
| Epoxy polyol resin 1 | 1200 parts |

The above-described starting materials were mixed in HENSCHEL MIXER and a mixture was obtained in which water was infiltrated into a pigment aggregate. The mixture was kneaded for 45 min with two rolls having a roll surface temperature set to 130° C., rolled, cooled, and ground in a pulverizer to obtain a master batch pigment. Then, the following materials

| | |
|---|---|
| Epoxy polyol resin 1 | 100 parts |
| The above-mentioned master batch pigment | 8 parts |
| Charge control agent (BONTRON E-84, manufactured by Orient Chemical Co., Ltd) | 2 parts |

were mixed in a mixer and melt kneaded with a two-roll mill. The kneaded product was rolled and cooled. Then, grinding and classification were conducted in the same manner as in the example of the manufacture of black colored particles, and colored particles of magenta color having a volume-average particle size of 8.5 mm were obtained. A total of 0.5 wt. % hydrophobic silica (H2000, Clariant Japan Co.) was then added, followed by mixing in a HENSCHEL MIXER The mixture was passed through a sieve with a mesh size of 50 min to remove the aggregates and obtain a magenta toner 1. The melt viscosity of the toner at a temperature of 140° C. was 17 mPas·sec.

[Cyan toner]

| | |
|---|---|
| Water | 600 parts |
| Water cake containing Pigment Blue 15:3 (content of solids 50%) | 1200 parts |
| Epoxy polyol resin 1 | 1200 parts |

The above-described starting materials were mixed in a HENSCHEL MIXER and a mixture was obtained in which water was infiltrated into a pigment aggregate. The mixture was kneaded for 45 min with two rolls having a roll surface temperature set to 130° C., rolled, cooled, and ground in a pulverizer to obtain a master batch pigment. Then, the following materials

| | |
|---|---|
| Epoxy polyol resin 1 | 100 parts |
| The above-mentioned master batch pigment | 8 parts |
| Charge control agent (BONTRON E-84, manufactured by Orient Chemical Co., Ltd.) | 2 parts |

were mixed in a mixer and melt kneaded with a two-roll mill. The kneaded product was rolled and cooled. Then, grinding and classification were conducted in the same manner as in the example of the manufacture of black colored particles and colored particles of cyan color having a volume-average particle size of 8.5 mm were obtained. A total of 0.5 wt. % hydrophobic silica (H2000, Clariant Japan Co.) was then added, followed by mixing in a HENSCHEL MIXER. The mixture was passed through a sieve with a mesh size of 50 mm to remove the aggregates and obtain a cyan toner 1. The melt viscosity of the toner at a temperature of 140° C. was 34 mPas·sec.

(Two-component Developer Evaluation)

When image evaluation was conducted with a two-component developer, the developer was prepared by using a ferrite carrier with an average particle size of 50 mm that was coated to an average coating thickness of 0.3 mm with a silicone resin, and toners of each color were uniformly mixed with the carrier and charged. Mixing was conducted at a ratio of 5 parts of the toner per 100 parts of the carrier in a tumbling mixer in which stirring was performed in a rotary container. A carrier with a low content of volatile components was manufactured by changing the coating conditions under which the resin was coated (evaporation temperature, time, atmosphere).

In Embodiment 1, the weight concentration of components soluble in polar solvents was 370 μg with respect to 1 g of the developer (Embodiments 2~22)

A toner and a developer were prepared and evaluated in the same manner as in Embodiment 1, except that the resins were used that were synthesized and manufactured in a similar manner by using starting materials shown in Table 3 The amounts of starting materials added and the physical properties of the resin are also shown in Table 3.

(Embodiment 23)

The evaluation was conducted in the same manner as in Embodiment 1, except that a phthalic acid ester of a propylene oxide adduct of bisphenol A type was used instead of diglycidylation product of propylene oxide adduct bisphenol A type. A polyol resin, 1000 g, with Mn: 3100, Mw/Mn: 6.1, Mp: 5000, softening point 112° C., Tg 58° C., and epoxy equivalent no less than 30,000 was obtained, in the polymerization reaction, the reaction conditions were controlled so that no monomer components remained. Polyalkylene group-containing portion in the main chain was confirmed by NMR. The polyester component was confirmed by IR spectroscopy. The weight concentration of components soluble in polar solvents in the resin was 53 μg with respect to 1 g of the resin.

(Embodiment 24)

The evaluation was conducted in the same manner as in Embodiment 1, except that the toner manufacturing conditions were changed so that the weight concentration of bisphenol A became 868 μg in respect to 1 g of the toner.

(Embodiment 25)

The evaluation was conducted in the same manner as in Embodiment 1, except that the toner manufacturing conditions were changed so that the weight concentration of bisphenol A became 356 μg in respect to 1 g of the toner.

(Embodiment 26)

The evaluation was conducted in the same manner as in Embodiment 1, except that the toner manufacturing conditions were changed so that the weight concentration of bisphenol A became 88 μg in respect to 1 g of the toner (Embodiment 27)

The evaluation was conducted in the same manner as in Embodiment 1, except that the toner manufacturing conditions were changed so that the weight concentration of bisphenol A became 9 μg in respect to 1 g of the toner (Embodiment 28)

The evaluation was conducted in the same manner as in Embodiment 1, except that the amount of volatile components in the pigment of each color or toner manufacturing conditions were adjusted so that the difference in concentration of components soluble in polar solvents between the black toner, cyan toner, magenta toner, and yellow toner was 14 μg/g with respect to 1 g of the toner of the corresponding colors.

(Embodiment 29)

The evaluation was conducted in the same manner as in Embodiment 1, except that the toner kneading conditions were changed so that the melt viscosity of the black toner at a temperature of 140° C. was 121 mPas·sec and the melt viscosity of the yellow toner at a temperature of 140° C. was 122 mPas·sec.

(Embodiment 30)

The evaluation was conducted in the same manner as in Embodiment 1, except that the toner kneading conditions were changed so that the softening point of the toner was 113° C. and the glass transition temperature (Tg) of the toner was 61° C.

(Embodiment 31)

The evaluation was conducted in the same manner as in Embodiment 1, except that the toner kneading conditions were changed so that the number-average molecular weight (Mn) of the toner was 3750, the (weight-average molecular weight)/(number-average molecular weight) (Mw/Mn) ratio was 4.0, and at least one peak molecular weight (Mp) was 5000.

(Embodiment 32)

The evaluation was conducted in the same manner as in Embodiment 1, except that acetone was used in the master batch pigment manufacture and the resin synthesis conditions were changed so that the epoxy equivalent of the binder resin was no less than 9000.

(Embodiment 33)

The evaluation was conducted in the same manner as in Embodiment 1, except that during master batch pigment manufacture in Embodiment 1, the master batch pigment was manufactured by mixing water, water-containing cake pigment, and resin, kneading for 30 min at a temperature of 150° C., adding 1000 parts of xylene, additionally kneading for 1 h, then removing water and xylene, rolling and cooling, grinding in a pulverizer, and passing twice through a three-roll mill. The weight concentration of components soluble in polar solvents in the master batch pigment was 483 μg in respect to 1 g of the toner.

(Embodiment 34)

The evaluation was conducted in the same manner as in Embodiment 1, except that water evaporation conditions were changed so that the water concentration in the binder resin was 1.2%.

(Embodiment 35)

The evaluation was conducted in the same manner as in Embodiment 1, except that during master batch pigment manufacture, a dry powder pigment was used as the pigment and the weight ratio of pigment (amount of solids), resin, and water was the same as in Embodiment 1. The weight concentration of components soluble in polar solvents in the master batch pigment was 18 μg in respect to 1 g of the toner.

(Embodiment 36)

The evaluation was conducted in the same manner as in Embodiment 1, except that the resin used in Embodiment 1 was replaced with a polyester resin (acid value 3, hydroxyl number: 25, Mn: 45,000, Mw/Mn: 4.0, Tg: 60° C.) and the amount of components soluble in polar solvents in the toner was decreased.

(Embodiment 37)

The evaluation was conducted in the same manner as in Embodiment 1, except that an evaluation machine B was used.

(Embodiment 38)

The evaluation was conducted in the same manner as in Embodiment 1, except that an evaluation machine C was used.

(Embodiment 39)

The evaluation was conducted in the same manner as in Embodiment 1, except that an evaluation machine D was used.

(Embodiment 40)

The evaluation was conducted in the same manner as in Embodiment 1, except that an evaluation machine E was used.

(Embodiment 41)

The evaluation was conducted in the same manner as in Embodiment 1, except that an evaluation machine F was used.

COMPARATIVE EXAMPLE 1

The evaluation was conducted in the same manner as in Embodiment 1, except that the toner manufacturing conditions, in particular, kneading and grinding conditions in Embodiment 1 were changed so that the weight concentration of components soluble in polar solvents was 1240 μg in respect to 1 g of the toner.

COMPARATIVE EXAMPLE 2

The evaluation was conducted in the same manner as in Embodiment 1, except that the resin employed in Embodiment 1 was replaced with a polyester resin (acid value: 4, Mn: 45,00, Mw/Mn: 4.0, Tg: 61° C., softening point 106° C.) and toner manufacturing conditions, in a particular, kneading and grinding conditions in Embodiment 1 were changed so that the weight concentration of components soluble in polar solvents was 1130 μg in respect to 1 g of the toner

TABLE 1

Result of evaluation

| | amount of composition (μg/g) soluble in polar solvent | evaluation machine | toner density | spent | heat resistance preservability | transparency | glossiness | color brightness | color reproducibility | curliness | environmental charge stability | fixability | resistance to polyvinyl sheets |
|---|---|---|---|---|---|---|---|---|---|---|---|---|---|
| embod. 1 | 21 | A | ◎ | ◎ | ○ | ○ | ◎ | ○ | ◎ | ○ | ○ | ○ | ○ |
| embod. 2 | 11 | A | ○ | ◎ | ○ | ○ | ◎ | ○ | ◎ | ○ | ◎ | Δ | ○ |
| embod. 3 | 3 | A | ○ | ◎ | ○ | ○ | ◎ | ◎ | ◎ | ○ | ◎ | ○ | ○ |
| embod. 4 | 10 | A | ○ | ◎ | ◎ | ○ | Δ | ○ | ○ | ○ | ◎ | ◎ | ○ |
| embod. 5 | 50 | A | ◎ | ○ | ○ | ○ | ○ | ○ | ○ | ○ | ◎ | ○ | ○ |
| embod. 6 | 102 | A | ○ | ○ | ○ | ○ | ◎ | ◎ | ◎ | ○ | ○ | Δ | ○ |
| embod. 7 | 120 | A | ○ | ○ | ○ | ○ | ○ | ○ | ○ | ○ | ○ | ○ | ○ |
| embod. 8 | 84 | A | ○ | ○ | ○ | ○ | ○ | ○ | ○ | ○ | ○ | ○ | ○ |
| embod. 9 | 33 | A | ◎ | ◎ | ○ | ○ | ◎ | ◎ | ◎ | ○ | ◎ | ○ | ○ |
| embod. 10 | 211 | A | ○ | ○ | ○ | ○ | ◎ | ◎ | ◎ | ○ | ○ | ○ | ○ |
| embod. 11 | 153 | A | ◎ | ○ | ○ | ○ | ◎ | ◎ | ◎ | ○ | ○ | Δ | ○ |
| embod. 12 | 22 | A | ○ | ◎ | ○ | ○ | ◎ | ○ | ○ | ○ | ◎ | Δ | ○ |
| embod. 13 | 13 | A | ○ | ◎ | ◎ | ○ | ○ | ○ | ◎ | ○ | ◎ | ○ | ○ |
| embod. 14 | 63 | A | ○ | ○ | ○ | ○ | ○ | ○ | ○ | ○ | ○ | ○ | ○ |
| embod. 15 | 62 | A | ◎ | ○ | ○ | ○ | ○ | ○ | ○ | ○ | ○ | ○ | ○ |
| embod. 16 | 45 | A | ◎ | ◎ | ○ | ○ | ○ | ○ | ○ | ○ | ◎ | ○ | ○ |
| embod. 17 | 9 | A | ○ | ◎ | ◎ | ○ | Δ | ○ | ○ | ○ | ◎ | ◎ | ○ |
| embod. 18 | 6 | A | ○ | ◎ | ◎ | ○ | ◎ | ◎ | ◎ | ○ | ◎ | Δ | ○ |
| embod. 19 | 22 | A | ○ | ◎ | ○ | ○ | ◎ | ◎ | ◎ | ○ | ◎ | Δ | ○ |
| embod. 20 | 47 | A | ◎ | ◎ | ○ | ○ | Δ | ○ | ○ | ○ | ◎ | ◎ | ○ |

TABLE 2

Result of evaluation

| | amount of composition (μg/g) soluble in polar solvent | evaluation machine | toner density | spent | heat resistance preservability | transparency | glossiness | color brightness | color reproducibility | curliness | environmental charge stability | fixability | resistance to polyvinyl sheets |
|---|---|---|---|---|---|---|---|---|---|---|---|---|---|
| embod. 21 | 36 | A | ○ | ◎ | ○ | ○ | ○ | ○ | ○ | ○ | ◎ | ○ | ○ |
| embod. 22 | 98 | A | ◎ | ○ | ○ | ○ | ◎ | ◎ | ◎ | ○ | ◎ | ○ | ○ |
| embod. 23 | 923 | A | ◎ | ○ | ○ | ○ | ◎ | ◎ | ◎ | ○ | ○ | ○ | ○ |

TABLE 2-continued

Result of evaluation

| | amount of composition (μg/g) soluble in polar solvent | evaluation machine | toner density | spent | heat resistance preservability | transparency | glossiness | color brightness | color reproducibility | curliness | environmental charge stability | fixability | resistance to polyvinyl sheets |
|---|---|---|---|---|---|---|---|---|---|---|---|---|---|
| embod. 24 | 432 | A | ◎ | ○ | ○ | ○ | ◎ | ◎ | ◎ | ○ | ◎ | ○ | ○ |
| embod. 25 | 103 | A | ◎ | ◎ | ○ | ○ | ◎ | ◎ | ◎ | ○ | ◎ | ○ | ○ |
| embod. 26 | 13 | A | ◎ | ◎ | ◎ | ○ | ◎ | ◎ | ◎ | ○ | ◎ | ○ | ○ |
| embod. 27 | 32 | A | ◎ | ◎ | ◎ | ○ | ◎ | ○ | ◎ | ○ | ◎ | ○ | ○ |
| embod. 28 | 34 | A | ◎ | ◎ | ○ | ○ | ◎ | ○ | ○ | ○ | ○ | Δ | ○ |
| embod. 29 | 52 | A | ◎ | ◎ | ○ | ○ | ◎ | ○ | ◎ | ○ | ○ | ◎ | ○ |
| embod. 30 | 34 | A | ◎ | ◎ | ○ | ○ | ○ | ◎ | ◎ | ○ | ○ | ○ | ○ |
| embod. 31 | 930 | A | ◎ | ○ | ○ | ○ | ◎ | ○ | ◎ | ○ | ○ | ○ | ○ |
| embod. 32 | 450 | A | ◎ | ○ | ○ | ○ | ◎ | ◎ | ◎ | ○ | ○ | ○ | ○ |
| embod. 33 | 65 | A | ◎ | ◎ | ○ | ○ | ◎ | ○ | ◎ | ○ | Δ | ○ | ○ |
| embod. 34 | 65 | A | ◎ | ◎ | ○ | ○ | ◎ | ◎ | ◎ | ○ | ○ | ○ | ○ |
| embod. 35 | 22 | A | ○ | ◎ | ◎ | ○ | ◎ | ○ | ◎ | ○ | ○ | ○ | ○ |
| embod. 36 | 21 | B | ◎ | ◎ | ○ | ○ | ○ | ○ | ◎ | ○ | ◎ | ◎ | ○ |
| embod. 37 | 21 | C | ◎ | ◎ | ○ | ○ | ○ | ○ | ◎ | ○ | ○ | ◎ | ○ |
| embod. 38 | 21 | D | ◎ | ◎ | ○ | ○ | ○ | ○ | ◎ | ○ | ○ | ◎ | ○ |
| embod. 39 | 21 | E | ◎ | ◎ | ○ | ○ | ○ | ○ | ◎ | ○ | ○ | ◎ | ○ |
| embod. 40 | 21 | F | ◎ | ◎ | ○ | ○ | ○ | ○ | ◎ | ○ | ○ | ◎ | ○ |
| comp. Ex. 1 | 1240 | A | ◎ | X | Δ | ○ | ◎ | ○ | ◎ | ○ | X | ○ | ○ |
| comp. Ex. 2 | 1130 | A | X | X | X | ○ | ◎ | ◎ | Δ | X | X | Δ | X |

TABLE 3

Example of resin synthesis and embodiment

| | | low molecular bisphenol A | | high molecular bisphenol A | | general formula 1 | | bisphenol F | bisphenol AD | bisphenol A | p-cuminylphenol | resin softening point | resin Tg obtained |
|---|---|---|---|---|---|---|---|---|---|---|---|---|---|
| | resin | mn | amount added (g) | mn | amount added (g) | n + m | amount added (g) | amount added (g) | amount added (g) | amount added (g) | amount added (g) | obtained ° C. | ° C. |
| embod. 1 | resin 1 | 360 | 378.4 | 2700 | 86 | 2.1 | 191 | 274.5 | — | — | 70.1 | 109 | 58 |
| embod. 2 | resin 2 | 360 | 205.3 | 3000 | 54 | 2.2 | 432 | 282.7 | — | — | 26 | 109 | 58 |
| embod. 3 | resin 3 | 360 | 252.6 | 10000 | 112 | 5.9 | 336 | — | 255.3 | — | 44.1 | 109 | 58 |
| embod. 4 | resin 4 | 2400 | 289.9 | 10000 | 232 | 6.0 | 309 | — | 117.5 | — | 51.6 | 116 | 61 |
| embod. 5 | resin 5 | 680 | 421.5 | 6500 | 107 | 2.0 | 214 | 210 | — | — | 47.5 | 114 | 60 |
| embod. 6 | resin 6 | 680 | 203.0 | 6500 | 58 | 2.2 | 462 | 254.6 | | — | 22.4 | 112 | 59 |
| embod. 7 | resin 7 | 680 | 370.6 | 6500 | 306 | 5.8 | 102 | — | 110.2 | — | 111.2 | 118 | 62 |
| embod. 8 | resin 8 | 680 | 238.4 | 6500 | 231 | 6.0 | 308 | — | 168.9 | — | 53.7 | 118 | 62 |
| embod. 9 | resin 9 | 680 | 401.9 | 6500 | 242 | 2.0 | 134 | 166 | — | — | 56.1 | 112 | 59 |
| embod. 10 | resin 10 | 680 | 200.7 | 6500 | 158 | 2.1 | 351 | 182.4 | — | — | 107.9 | 112 | 59 |
| embod. 11 | resin 11 | 460 | 430.0 | 6500 | 188 | 5.9 | 116 | 209.2 | — | — | 56.8 | 107 | 57 |
| embod. 12 | resin 12 | 680 | 218.8 | 6500 | 172 | 6.0 | 382 | 176.8 | — | — | 50.4 | 112 | 59 |
| embod. 13 | resin 13 | 680 | 275.4 | 6500 | 194 | 2.3 | 269 | — | 203.5 | — | 58.1 | 114 | 60 |
| embod. 14 | resin 14 | 680 | 244.5 | 6500 | 188 | 7.9 | 348 | — | 169.9 | — | 49.6 | 112 | 59 |
| embod. 15 | resin 15 | 680 | 258.3 | 6500 | 199 | 4.2 | 276 | — | — | 198.3 | 68.3 | 114 | 60 |
| embod. 16 | resin 16 | 400 | 156.1 | 6500 | 350 | 4.0 | 230 | — | — | 119.7 | 144.1 | 114 | 60 |
| embod. 17 | resin 17 | 2000 | 17.6 | 11000 | 423 | 6.2 | 385 | 109.6 | — | — | 64.7 | 118 | 62 |

TABLE 3-continued

Example of resin synthesis and embodiment

| | resin | low molecular bisphenol A mn | low molecular bisphenol A amount added (g) | high molecular bisphenol A mn | high molecular bisphenol A amount added (g) | general formula 1 n + m | general formula 1 amount added (g) | bisphenol F amount added (g) | bisphenol AD amount added (g) | bisphenol A amount added (g) | p-cuminyl-phenol amount added (g) | resin softening point obtained ° C. | resin Tg obtained ° C. |
|---|---|---|---|---|---|---|---|---|---|---|---|---|---|
| embod. 18 | resin 18 | 340 | 438.1 | 3000 | 54 | 1.9 | 108 | — | 347.9 | — | 51.9 | 112 | 59 |
| embod. 19 | resin 19 | 400 | 251.2 | 6500 | 50 | 2.0 | 400 | 276 | — | — | 22.7 | 112 | 59 |
| embod. 20 | resin 20 | 680 | 82.3 | 6500 | 683 | 4.0 | 125 | — | — | 9.3 | 180 | 118 | 63 |
| embod. 21 | resin 21 | 680 | 428.7 | 6500 | 318 | 3.8 | 21 | — | — | 92.3 | 140 | 114 | 60 |
| embod. 22 | resin 22 | 680 | 411.9 | — | — | 3.8 | 350 | — | — | 199.2 | 38.9 | 113 | 58 |

The above-described toner and developer for electrostatic image development in which the weight concentration of components soluble in polar solvents in the toner was restricted demonstrated high environmental safety, increased resistance to toner spent formation, stable fixing characteristic and preservability, and excellent environmental charge stability, which made it possible to obtain images stable under various environmental conditions and images which are not transferred onto a vinyl chloride mat. Furthermore, when color toners were produced, a printed product could be obtained which demonstrated appropriate glossiness and color reproducibility and had substantially no curling on the image surface.

What is claimed is:

1. A toner for developing a latent electrostatic image to a toner image, comprising:

a binder resin comprising a polyol resin; and a coloring agent, with the total amount of a polar-solvent-soluble material contained in said toner being 1000 $\mu$g or less with respect to 1 g of said toner.

2. The toner as claimed in claim 1, wherein said polar-solvent-soluble material comprises bisphenol A.

3. The toner as claimed in claim 1, wherein said polar-solvent-soluble material contained in said toner is 3 $\mu$g or more.

4. The toner as claimed in claim 1, wherein said toner has a melt viscosity of 120 mPas·sec or less at 140° C.

5. The toner as claimed in claim 1, which has a softening point of 70~160° C. and a glass transition temperature (Tg) of 40~70° C.

6. The toner as claimed in claim 1, which has a number-average molecular weight (Mn) of 2000~8000, a (weight-average molecular weight)/(number-average molecular weight) (Mw/Mn) ratio of 1.5~20, and at least one peak molecular weight (Mp) of 3000~7000.

7. The toner as claimed in claim 1, wherein the polyol resin comprises an epoxy resin portion and a polyalkylene group-containing portion at least in the main chain.

8. The toner as claimed in claim 7, wherein the polyol resin further comprises a polyester portion at least in the main chain.

9. The toner as claimed in claim 7, wherein said polyol resin further comprises inactive terminal groups.

10. The toner as claimed in claim 7, wherein the polyol resin is prepared by a reaction of (1) an epoxy resin, (2) at least one of alkylene oxide adducts of diphenols and glycidyl ethers thereof (3) a compound containing in a molecule thereof one active hydrogen atom reactable with an epoxy group, and (4) a compound containing in a molecule thereof two or more active hydrogen atoms reactable with an epoxy group.

11. The toner as claimed in claim 10, wherein the epoxy resin comprises two or more epoxy resins of bisphenol A type with different number-average molecular weights.

12. The toner as claimed in claim 11, wherein said two or more epoxy resins of bisphenol A type with different number-average molecular weights comprise a low-molecular-weight component with a number-average molecular weight of 360~2,000 and a high-molecular-weight component with a number-average molecular weight of 3,000~10,000.

13. The toner as claimed in claim 12, wherein the content of the low-molecular-weight component in the polyol resin is 20~50 wt. % and the content of the high-molecular-weight component in the polyol resin is 5~40 wt. %.

14. The toner as claimed in claim 10, wherein the glycidyl ethers of alkylene oxide adducts of diphenols are diglycidyl ethers of alkylene oxide adducts of bisphenol A, which are represented by the General Formula (1) below:

(1)

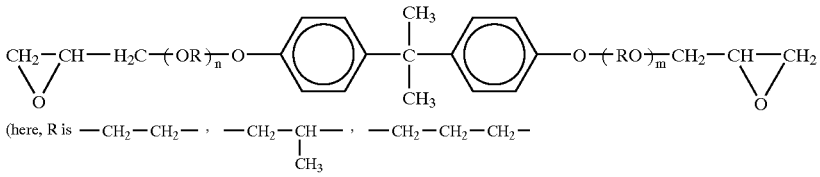

And n, m are repetition units, respectively greater than 1, and meets equation n+m=2~8.

15. The toner as claimed in claim 10, wherein the content of alkylene oxide adducts of diphenols and glycidyl ethers thereof in the polyol resin is 10~40 wt. %.

16. The toner as claimed in claim 7, wherein the epoxy equivalent in the binder resin is 20,000 or more.

17. A set of at least three color toners for developing a latent electrostatic image to a multi-color image, each color toner comprising a binder resin and a coloring agent, with the total amount of a polar-solvent-soluble material contained in each of said color toners being 1000 μg or less with respect to 1 g of each of said color toners, and the amount of said polar-solvent-soluble material in at least one of said color toners being different from the amount of said polar-solvent-soluble material of any of said other color toners by an amount of 300 μg or less with respect to 1 g of any of said other color toners.

18. A resin for binder resin contained in a toner for developing electrostatic images, wherein the resin has an epoxy resin portion and a polyalkylene group-containing portion at least in a main chain, wherein the resin contains polar-solvent-soluble material at 1000 μg/g or less.

19. The resin as claimed in claim 18, which is manufactured by adding water at any stage from before to after synthesis of said resin, then bubbling a liquid component containing said water under reduced pressure, and evaporating the liquid component containing said water.

20. A method for manufacturing the resin as claimed in claim 19, comprising the steps of:

adding water at any time before the beginning of synthesis reaction of said resin to the end thereof;

bubbling a liquid containing said water under reduced pressure; and evaporating the liquid containing said water.

21. A master batch pigment for a toner for developing electrostatic images, wherein a pigment is dispersed in a resin for a toner having an epoxy resin portion and a polyalkylene group-containing portion at least in the main chain, wherein said master batch pigment contains polar-solvent-soluble material at 500 μg/g or less.

22. The master batch pigment for a toner as claimed in claim 21, wherein said pigment is a dry powder pigment, and said master batch pigment is obtained by preparing a mixture of said dry powder pigment, the resin and water, and kneading said mixture to remove said water.

23. A method for manufacturing a master batch pigment for a toner as claimed in claim 22, comprising the steps of:

preparing a mixture of said dry powder pigment and a said resin and the water; and heating and kneading said mixture to remove said water.

24. An electrostatic image developer comprising a toner for developing electrostatic images comprising a binder resin comprising a polyol resin, and a coloring agent, with the total amount of a polar-solvent-soluble material contained in said toner being 1000 μg or less with respect to 1 g of said toner.

25. The electrostatic image developer as claimed in claim 24, wherein the total amount of said polar-solvent-soluble material contained in said toner being 500 μg or less with respect to 1 g of said toner.

26. A method for forming an image, comprising the steps of:

forming a latent electrostatic image on a latent electrostatic image bearing member; and developing said latent electrostatic image to form a toner image with an electrostatic image developer provided in a developing apparatus which contains a toner comprising a binder resin comprising a polyol resin, and a coloring agent and contains polar-solvent-soluble material at 1000 μg or less with respect to 1 g of said toner.

* * * * *